US012193474B2

(12) United States Patent
Karga et al.

(10) Patent No.: US 12,193,474 B2
(45) Date of Patent: Jan. 14, 2025

(54) STABILIZATION METHODS FOR TOBACCO AND TOBACCO PRODUCTS

(71) Applicant: Altria Client Services LLC, Richmond, VA (US)

(72) Inventors: Yahya Karga, Richmond, VA (US); James Powell, Richmond, VA (US); Dongmei Xu, Glen Allen, VA (US); James A. Strickland, Richmond, VA (US); Ujwala Warek, Richmond, VA (US)

(73) Assignee: Altria Client Services LLC, Richmond, VA (US)

( * ) Notice: Subject to any disclaimer, the term of this patent is extended or adjusted under 35 U.S.C. 154(b) by 27 days.

(21) Appl. No.: 17/892,239

(22) Filed: Aug. 22, 2022

(65) Prior Publication Data

US 2022/0395014 A1 Dec. 15, 2022

Related U.S. Application Data

(62) Division of application No. 16/054,351, filed on Aug. 3, 2018, now Pat. No. 11,457,659.

(60) Provisional application No. 62/541,549, filed on Aug. 4, 2017.

(51) Int. Cl.

| | |
|---|---|
| ***A24B 15/22*** | (2006.01) |
| ***A24B 13/00*** | (2006.01) |
| ***A24B 15/10*** | (2006.01) |
| ***A24B 15/18*** | (2006.01) |
| ***A24B 15/28*** | (2006.01) |

(52) U.S. Cl.
CPC ..... *A24B 15/22* (2013.01); *A24B 13/00* (2013.01); *A24B 15/183* (2013.01); *A24B 15/10* (2013.01); *A24B 15/186* (2013.01); *A24B 15/28* (2013.01)

(58) Field of Classification Search
CPC ..... A24B 15/22; A24B 15/183; A24B 15/01
See application file for complete search history.

(56) References Cited

U.S. PATENT DOCUMENTS

| | | | | |
|---|---|---|---|---|
| 4,516,590 | A | 5/1985 | Teng | |
| 4,528,993 | A | 7/1985 | Sensabaugh, Jr. et al. | |
| 4,660,577 | A | 4/1987 | Sensabaugh et al. | |
| 4,848,373 | A | 7/1989 | Lenkey | |
| 4,987,907 | A | 1/1991 | Townend | |
| 5,065,775 | A * | 11/1991 | Fagg | A24B 15/24 356/443 |
| 5,372,149 | A | 12/1994 | Roth et al. | |
| 6,311,695 | B1 * | 11/2001 | Williams | A24B 15/18 131/299 |
| 7,694,686 | B2 | 4/2010 | Atchley et al. | |
| 8,168,855 | B2 | 5/2012 | Nielsen et al. | |
| 8,469,036 | B2 | 6/2013 | Williams et al. | |

(Continued)

*Primary Examiner* — Christopher M Rodd
*Assistant Examiner* — Jennifer A Kessie
(74) *Attorney, Agent, or Firm* — Harness, Dickey & Pierce, P.L.C.

(57) ABSTRACT

A stabilizing process for tobacco and tobacco products includes sterilizing the tobacco by applying an electron beam treatment to the tobacco. The process may also include treating the tobacco. The treating the tobacco includes pre-conditioning the tobacco, pasteurizing the tobacco, curing the tobacco, fermenting the tobacco, or combinations thereof. The method may also include forming a smokeless tobacco product containing the tobacco.

20 Claims, 13 Drawing Sheets

(56) References Cited

U.S. PATENT DOCUMENTS

| | | | | |
|---|---|---|---|---|
| 8,627,828 | B2 | 1/2014 | Strickland et al. | |
| 8,978,661 | B2 | 3/2015 | Atchley et al. | |
| 9,066,540 | B2 | 6/2015 | Atchley et al. | |
| 2002/0162562 | A1 | 11/2002 | Williams | |
| 2004/0118422 | A1 | 6/2004 | Lundin et al. | |
| 2005/0178398 | A1 | 8/2005 | Breslin et al. | |
| 2005/0244521 | A1 | 11/2005 | Strickland et al. | |
| 2006/0191548 | A1 | 8/2006 | Strickland et al. | |
| 2008/0209586 | A1 | 8/2008 | Nielsen et al. | |
| 2012/0024301 | A1 | 2/2012 | Carroll et al. | |
| 2012/0031414 | A1 | 2/2012 | Atchley et al. | |
| 2012/0031416 | A1 | 2/2012 | Atchley et al. | |
| 2017/0064993 | A1* | 3/2017 | Nordskog ..... | A24B 13/00 |

* cited by examiner

Microbial Results at Week 4 from Study 1

Microbial Results at Week 8 from Study 1

Microbial Results at Week 16 from Study 1

Impact of Moisture on Nitrite Formation

| Dose (kGy) | Moisture OV% | | | | | |
|---|---|---|---|---|---|---|
| | 5 | 15 | 25 | 35 | 45 | 55 |
| Control | 0 | 0 | 0 | 0 | 0 | 0 |
| 10 | 36.90 | 0 | 0 | 0 | 0 | 0 |
| 20 | 54.99 | 13.55 | 0 | 0 | 0 | 0 |

FIG. 12

NITRITE FORMATION IN E-BEAMED CFC DF

NITRITE FORMED IN DIFFERENT LEVELS OF OV%

| SAMPLE OV% | DOSE, kGy | SAMPLE A NITRITE, BDW, ug/g | SAMPLE B NITRITE, BDW, ug/g | SAMPLE C NITRITE, BDW, ug/g |
|---|---|---|---|---|
| 5% | 0 | BLOQ | BLOQ | BLOQ |
| | 10 | 36.90 | 31.75 | 30.26 |
| | 20 | 54.99 | 45.50 | 47.85 |
| 15% | 0 | ND | | BLOQ |
| | 10 | BLOQ | BLOQ | BLOQ |
| | 20 | 13.55 | BLOQ | 11.53 |
| 25% | 0 | ND | | BLOQ |
| | 10 | BLOQ | BLOQ | BLOQ |
| | 20 | BLOQ | BLOQ | BLOQ |
| 35% | 0 | ND | | |
| | 10 | BLOQ | BLOQ | |
| | 20 | BLOQ | BLOQ | |
| 45% | 0 | ND | | |
| | 10 | BLOQ | BLOQ | |
| | 20 | BLOQ | BLOQ | |
| 55% | 0 | ND | BLOQ | |
| | 10 | ND | BLOQ | |
| | 20 | BLOQ | BLOQ | |

NITRITE WAS MEASURED USING STANDARD SAMPLE WEIGHT AT WK2

NITRITE WAS MEASURED USING 2G DW TOBACCO AT WK5

NITRITE WAS MEASURED USING 2G DW TOBACCO AT WK2

NOTE: ALL SAMPLES WERE TREATED USING 5 MeV ACCELERATOR.

FIG. 14

| Sample Name | OV% | Dose (kGy) | Nitrite, BDW (ug/g) |
|---|---|---|---|
| Long-cut, Raw Dried (uncured) Tobacco | 5% | 0 | BLOQ |
| | | 10 | 26.8 |
| | | 15 | 39.5 |
| | | 20 | 45.9 |
| Undried (uncured) Tobacco | 25% | 0 | BLOQ |
| | | 10 | BLOQ |
| | | 15 | BLOQ |
| | | 20 | BLOQ |

Nitrite was Measured Using 1g DW Tobacco.
Samples Were Measured at Wk 2.
All Samples Were Treated Using 5 MeV Accelerator.

FIG. 15

STABILIZATION METHODS FOR TOBACCO AND TOBACCO PRODUCTS

CROSS-REFERENCE TO RELATED APPLICATIONS

This application is a Divisional application of U.S. application Ser. No. 16/054,351, dated Aug. 3, 2018, which claims the benefit of U.S. Provisional Application No. 62/541,549, filed on Aug. 4, 2017, the disclosure of each of which is incorporated herein by reference thereto in its entirety.

BACKGROUND

Field

At least one example embodiments relates to stabilization methods for tobacco and tobacco products.

Description of Related Art

Tobacco is a natural agricultural product, which contains many indigenous microorganisms and insects. Such microorganisms and insects become introduced in the tobacco during tobacco processing steps such as growing, harvesting, curing, etc. Microorganisms and insects, under certain conditions, can change the chemistry and flavor profile of the tobacco. Furthermore, insects can cause a significant loss of stored tobacco leaves during an infestation. The tobacco can be treated using processes, such as heat pasteurization, to reduce the level of or eliminate microorganisms and pests present in the tobacco. Some processes, such as heat pasteurization, require exposing the tobacco to an elevated temperature (e.g., 175-200° F.) for a prolonged amount of time (e.g., 5-20 minutes).

SUMMARY

At least some example embodiments relate to microbiological stabilization methods (e.g., partial or full sterilization) for preparing tobacco products, such as reducing the levels of naturally existing microbes including bacteria, such as spore-forming (e.g., microflora) bacteria, and molds in the tobacco. At least some example embodiments can eliminate and/or reduce undesirable microbial species present in the tobacco. This reduction of existing microbial populations may, in turn, eliminate and/or reduce chemical changes and off-flavors that develop in tobacco and tobacco products over time. Accordingly, reducing the microbial species from the tobacco may stabilize and/or improve the product quality of tobacco products containing the tobacco.

In at least some example embodiments, the stabilization methods provided herein can include applying a sterilization process that eliminates or reduces an amount of microbes (e.g., bacterial, spores, and fungal species) in the tobacco and products containing the tobacco. The resulting stabilized products may therefore have a longer product retail shelf life than other products, e.g., products that have not been subjected to the methods described herein.

In at least some example embodiments, the stabilization methods described herein can include a sterilization process that eliminates and/or reduces damage causing pests (e.g., insects, larva, and eggs) in incoming and stored raw materials. Unlike chemical treatments used for controlling insect infestation in agricultural goods, insects cannot develop a resistance to the sterilization processes described herein.

Accordingly, the stabilization methods provided herein may effectively mitigate damage and/or infestation of raw agricultural materials caused by such pests.

In at least some example embodiments, the stabilization methods described herein may include a sterilization process that eliminates and/or reduces damage related to microbe (fungal or bacterial) activity in stored raw tobacco materials. Accordingly, the stabilization methods provided herein may effectively mitigate damage of raw agricultural materials caused by such microbes.

In at least some example embodiments, the sterilization processes described herein include the use of an electron beam (E-Beam) treatment, which is a process that applies high-energy electrons to a product, such as tobacco. E-Beam treatments may disinfect tobacco creating less oxidative degradation, as compared to other forms of sterilization (e.g., gamma radiation). Furthermore, E-Beam treatment does not use a radioactive source and therefore may provide a more convenient method of sterilization, as compared to the other sterilization processes.

In at least some example embodiments, the methods provided herein can be applied to tobacco and tobacco products to reduce and/or eliminate microbes, such as nitrate-reducing bacterial strains. Nitrate-reducing bacteria have a potential to impact key characteristics of a finished product (e.g., taste, aroma, flavor, texture, and/or appearance) during, and/or after the product is manufactured. Furthermore, nitrites in the tobacco can have a potential for forming tobacco specific nitrosamines (TSNAs) in the tobacco or a tobacco product containing the tobacco. Accordingly, some example embodiments of the stabilization methods described herein can include methods of partially or fully sterilizing without forming, or reducing and/or minimizing if any, nitrites in tobacco or a tobacco product during the sterilization step through the end of retail shelf life.

In at least some example embodiments, a method for producing a smokeless tobacco product includes stabilizing tobacco, where the stabilizing includes sterilizing the tobacco by applying an electron beam to the tobacco. The method also includes treating the tobacco, such as by pre-conditioning the tobacco, pasteurizing the tobacco, curing the tobacco, fermenting the tobacco, or combinations thereof. The method further includes forming a smokeless tobacco product containing the tobacco.

In at least one example embodiment, the tobacco has a pH ranging from about 3 to about 7. In at least one example embodiment, the tobacco has a pH ranging from about 4 to about 5. In some embodiments, the tobacco has a pH of about 8, about 7, about 6, or about 5.

In at least one example embodiment, the stabilizing step can include conditioning the tobacco to have certain properties, such as a desired pH. In at least one embodiment, the stabilizing includes conditioning the tobacco such that the tobacco has a pH of less than about 8, optionally less than about 7, optionally less than about 6, and optionally less than about 5. In at least one example embodiment, the stabilizing the tobacco includes conditioning the tobacco to have a pH ranging from about 2 to about 8. In at least one example embodiment, the conditioning the tobacco includes increasing or decreasing the pH of the tobacco. In at least one example embodiment, the conditioning includes adding a pH buffering agent to the tobacco. The pH buffering agent can include sodium hydroxide (NaOH).

In at least one example embodiment, the methods described herein can include processing tobacco to have a desired moisture oven volatile content. In some embodiments, the moisture oven volatile content of the tobacco is greater than about 5% by weight. In at least one example embodiment, the conditioning includes adjusting the moisture oven volatile content of the tobacco to greater than about 5% by weight, optionally greater than about 15% by weight, and optionally greater than about 25% by weight. In at least one example embodiment, the conditioning the tobacco comprises adjusting the moisture oven volatile content of the tobacco to a value ranging from about 25% by weight to about 55% by weight.

The sterilizing step can include applying a desired E-Beam dosage amount during an E-Beam treatment. In at least one example embodiment, the E-Beam treatment dosage ranges from about 10 kilogray (kGy) to about 20 kGy. In at least one example embodiment, the E-Beam treatment dosage is greater than about 0 kGy, but no more than about 20 kGy to the tobacco. In some embodiments, the E-Beam treatment dosage is greater than or equal to about 10 kGy, optionally greater than or equal to about 15 kGy, and optionally greater than or equal to about 20 kGy. In at least one example embodiment, the E-Beam treatment dosage is about 10 kGy, about 15 kGy, or 20 kGy. In at least one example embodiment, the tobacco has a moisture oven volatile content of greater than about 5% by weight and sterilizing includes applying an E-Beam treatment dosage of greater than about 20 kGy to the tobacco. In at least one example embodiment, the tobacco has a moisture oven volatile content of greater than about 15% by weight and stabilizing includes applying an E-Beam treatment dosage of greater than about 10 kGy.

The stabilizing step can be applied at a desired (or, alternatively predetermined) point during the method, or a particular condition. In at least one example embodiment, the stabilizing occurs before the treatment (e.g., curing). In at least one example embodiment embodiments, the stabilizing occurs concurrently with the treatment (e.g., curing). In some embodiments, the stabilizing occurs after the treatment (e.g., curing). In at least one example embodiment, the conditioning occurs after the treatment (e.g., curing), but before the sterilizing. In at least one example embodiment, the conditioning occurs concurrently with the sterilizing. In at least one example embodiment, the tobacco comprises a raw dried tobacco, raw undried tobacco, a fermented tobacco, a cured tobacco, or combinations thereof. In at least one example embodiment, the sterilizing occurs at about room temperature (i.e., about 25° C.). In at least one example embodiment, the stabilizing occurs at a temperature ranging from about 10° C. to about 40° C.

In at least one example embodiment, the sterilizing step is configured to reduce a microflora bacteria count. In at least one example embodiment, the sterilizing includes reducing microflora bacteria present in the tobacco by about 99.9%. In at least one example embodiment, the sterilizing includes reducing a microflora bacteria count in the tobacco to less than about 106 colony-forming unit (CFU) per gram of the tobacco, optionally less than about 105 CFU per gram of the tobacco, optionally less than about 104 CFU per gram of the tobacco, optionally less than about 103 CFU per gram of the tobacco, and optionally less than about 102 CFU per gram of the tobacco.

The stabilizing step can be applied over a desired (or, alternatively predetermined) time frame or duration. In some example embodiments, the stabilizing is performed for a duration of less than about 1 minute, optionally less than about 30 seconds, optionally less than about 10 seconds, and optionally less than 5 seconds, and optionally less than about 3 seconds.

In at least some example embodiments, the stabilizing step is configured to eliminate and/or reduce the nitrite level of the tobacco. In some example embodiments, the stabilizing does not cause formation of or substantially increase a nitrite level in the tobacco or a tobacco product containing the tobacco. In at least one example embodiment, the stabilizing does not increase the nitrite level in the tobacco or a tobacco product containing the tobacco by greater than 300 micrograms (μg) of nitrite per every gram of dry tobacco. In at least one example embodiment, the stabilizing does not increase the nitrite level in the tobacco or a tobacco product containing the tobacco by greater than 150 micrograms of nitrite per gram of dry tobacco. In at least one example embodiment, the stabilizing does not increase the nitrite level in the tobacco or a tobacco product containing the tobacco by greater than 10 μg of nitrite per gram of dry tobacco.

In at least some example embodiments, a method for producing a smokeless tobacco product includes treating tobacco, the treating including: pre-conditioning the tobacco, pasteurizing the tobacco, curing the tobacco, fermenting the tobacco, or combinations thereof; conditioning the tobacco; forming a product containing the tobacco; and stabilizing the product including sterilizing the product using an electron beam treatment.

The conditioning step can be applied at a desired (or, alternatively predetermined) point during the method. In at least one example embodiment, the conditioning is performed prior to the treating. In at least one example embodiment, the conditioning is performed concurrently with the treating. In some example embodiments, the conditioning occurs after the treating and before the sterilizing. In some example embodiments, the conditioning occurs concurrently with the sterilizing.

The sterilizing step can include applying a desired E-Beam dosage amount during an E-Beam treatment. In at least one example embodiment, the sterilizing comprises applying an E-Beam treatment dosage ranging from about 10 kGy to about 20 kGy to the tobacco. In at least one example embodiment, the E-Beam treatment dosage is greater than about 0 kGy, but no more than about 20 kGy to the tobacco. In at least one example embodiment, the E-Beam treatment dosage is greater than or equal to about 10 kGy, and optionally greater than or equal to about 20 kGy. In at least one example embodiment, the E-Beam treatment dosage is about 10, optionally about 15, and optionally about 20 kGy. In at least one example embodiment, the tobacco has a moisture oven volatile content of greater than about 5% by weight and the E-Beam treatment dosage is greater than about 20 kGy. In at least one example embodiment, the tobacco has a moisture oven volatile content of greater than about 15% by weight and the E-Beam treatment dosage is greater than about 10 kGy.

In at least one example embodiment, the stabilizing is configured to prevent and/or reduce microbial growth in the product for greater than or equal to about 10, optionally greater than or equal to about 15, optionally greater than or equal to about 20, optionally greater than or equal to about 30, and optionally greater than or equal to about 60 weeks.

In at least some example embodiments, a method for producing a smokeless tobacco product includes stabilizing tobacco, where the stabilizing includes sterilizing the tobacco by applying an electron beam treatment to the tobacco. The method also includes forming a smokeless tobacco product containing the stabilized tobacco.

In at least some example embodiments, a smokeless tobacco product contains stabilized, fermented tobacco produced by a method, which includes stabilizing the tobacco by applying an electron beam treatment to the tobacco; fermenting the tobacco; and adding the stabilized, fermented tobacco in a tobacco container.

Other aspects, features, and advantages are in the description, drawings, and claims.

BRIEF DESCRIPTION OF THE DRAWINGS

The various features and advantages of the non-limiting embodiments herein may become more apparent upon review of the detailed description in conjunction with the accompanying drawings. The accompanying drawings are merely provided for illustrative purposes and should not be interpreted to limit the scope of the claims. The accompanying drawings are not to be considered as drawn to scale unless explicitly noted. For purposes of clarity, various dimensions of the drawings may have been exaggerated.

FIG. 12 is a chart providing nitrite formation data for fine-cut, unfermented tobacco tested with different treatment dosages, and at different moisture content levels according to at least one example embodiment.

FIG. 14 is a chart providing nitrite levels in various exemplary samples of a fine-cut unfermented tobacco with different oven volatiles contents, which were subjected to varying E-Beam treatment dosage levels according to at least one example embodiment.

FIG. 15 is a chart providing nitrite levels in example tobaccos, including a long-cut, unfermented, dried tobacco and an undried, unfermented tobacco, subjected to varying E-Beam treatment dosage levels according to at least one example embodiment.

DETAILED DESCRIPTION

Figure 1:
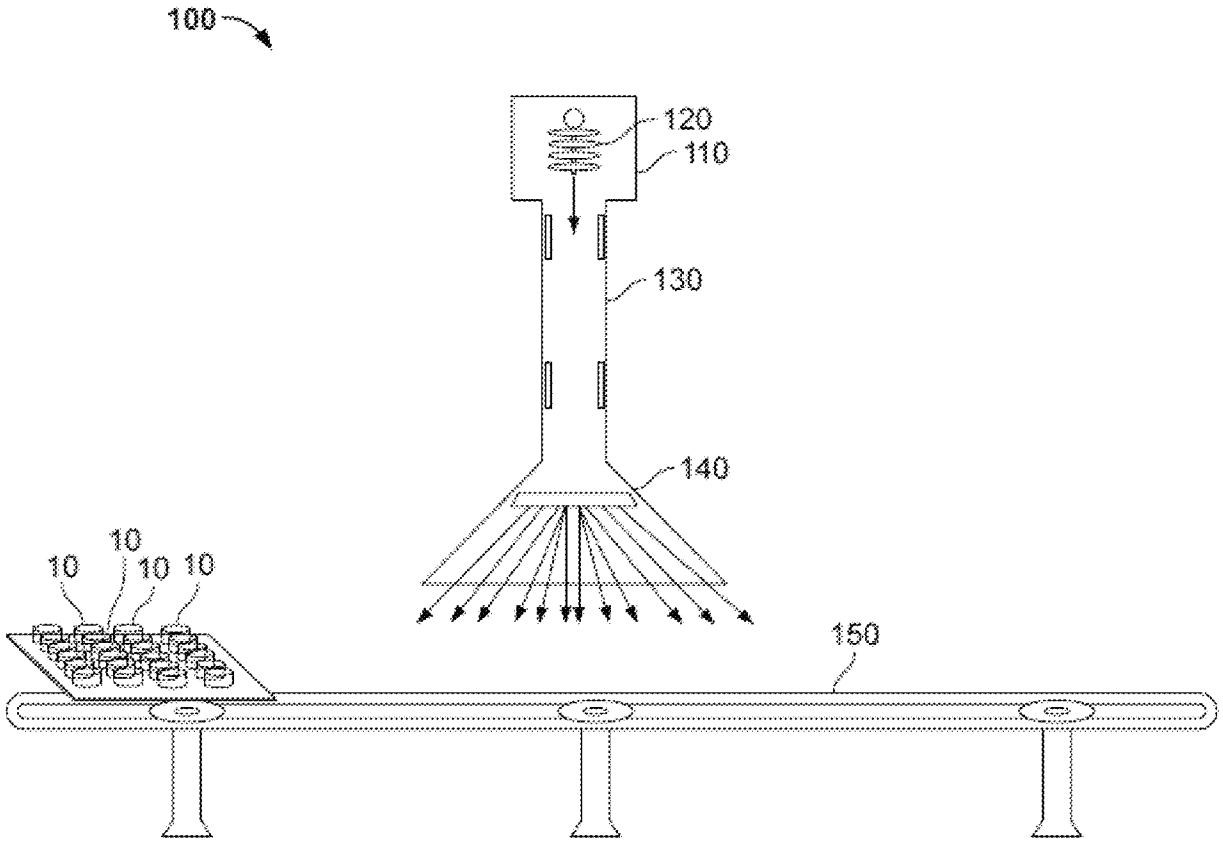
FIG. 1 is a schematic view of a process that includes an E-Beam accelerator according to at least one example embodiment.

Example embodiments will become more readily understood by reference to the following detailed description of the accompanying drawings. Example embodiments may, however, be embodied in many different forms and should not be construed as being limited to the example embodiments set forth herein. Rather, these example embodiments are provided so that this disclosure will be thorough and complete. Like reference numerals refer to like elements throughout the specification.

The terminology used herein is for the purpose of describing particular embodiments only and is not intended to be limiting. As used herein, the singular forms "a", "an" and "the" are intended to include the plural forms as well, unless the context clearly indicates otherwise. It will be further understood that the terms "comprises," "comprising," "includes," and/or "including," when used in this specification, specify the presence of stated features, integers, steps, operations, elements, and/or components, but do not preclude the presence or addition of one or more other features, integers, steps, operations, elements, components, and/or groups thereof.

It will be understood that when an element or layer is referred to as being "on", "connected to" or "coupled to" another element or layer, it can be directly on, connected or coupled to the other element or layer or intervening elements or layers may be present. In contrast, when an element is referred to as being "directly on", "directly connected to" or "directly coupled to" another element or layer, there are no intervening elements or layers present. As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings set forth herein.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Example embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, these example embodiments should not be construed as limited to the particular shapes of regions illustrated herein, but are to include deviations in shapes that result, for example, from manufacturing. Thus, the figures are schematic in nature and their shapes are not intended to illustrate the actual shape of a region of a device and are not intended to limit the scope of this disclosure.

Unless otherwise defined, all terms (including technical and scientific terms) used herein have the same meaning as commonly understood by one of ordinary skill in the art. It will be further understood that terms, such as those defined in commonly used dictionaries, should be interpreted as having a meaning that is consistent with their meaning in the context of the relevant art and this specification and will not be interpreted in an idealized or overly formal sense unless expressly so defined herein.

At least one example embodiment relates to stabilization methods for tobacco and tobacco products. The methods described herein can produce a high quality tobacco product having a desirable composition, taste, texture, flavor, aroma, and/or appearance. In at least one example embodiment, the stabilization methods provided herein can include applying a sterilization process for eliminating and/or reducing an amount of microbes (e.g., bacterial spores and fungal species) in the tobacco and/or tobacco products. The sterilization process can be applied, in at least one example embodiment, to eliminate or reduce pest (e.g., insects, larva, and eggs) in incoming and stored raw tobacco materials.

In at least one example embodiment, the stabilization method can optionally include a conditioning process for obtaining a desired characteristic of the tobacco and/or tobacco product (e.g., pH and/or moisture content of the tobacco and/or tobacco product) before, during, and/or after the stabilization. The conditioning processes can help to reduce an amount of and/or prevent formation of nitrites and nitrosamines in a harvested tobacco plant or a tobacco product subjected to the stabilization.

The stabilizing methods described herein are not limited to tobacco and tobacco products, and may be applicable to other types of oral products (e.g., gum or pharmaceuticals), consumable products (e.g., foods), and/or packaging components and products (e.g., wine cork). The stabilization methods described herein may be applicable to other industries other than those related to the tobacco industry, such as pharmaceutical, medical devices, food and agriculture, coating, welding, aerospace, defense, and pest/pathogen control industries.

In at least one example embodiment, the methods described herein can partially and/or fully sterilize tobacco and tobacco products without substantially impacting the taste, texture, flavor, aroma, and/or color of the tobacco and tobacco products. In at least one example embodiment, the methods described herein can extend the retail shelf life of tobacco and/or tobacco products, such as moist smokeless tobacco (MST) products. Accordingly, tobacco and/or tobacco-containing products that are subjected to the stabilization methods described herein may have a longer retail shelf life than those that have not.

In at least one example embodiment, the stabilization processes can be used to reduce the initial amount of microbes, and/or retard the growth of the microorganisms, which can affect the shelf life and freshness of tobacco and tobacco products (e.g., MST). The use of E-Beam technology is not limited to tobacco product (e.g., MST), but can include other forms of tobacco, such as unfinished or raw forms of tobacco. In at least one example embodiment, the E-Beam treatments may be applied to unfinished tobacco (e.g., fermented tobacco) and/or unprocessed tobacco (e.g., unfermented tobacco). The stabilization processes described herein can be applied to fermented forms or unfermented forms of tobacco to disinfect and partially and/or fully sterilize the tobacco. In at least one example embodiment, the stabilization processes described herein can improve the tobacco quality during the tobacco product retail shelf life. In at least one example embodiment, the stabilization processes described herein can extend the storage life of the fermented or unfermented tobacco and/or products derived therefrom.

In at least one example embodiment, the stabilization processes do not cause the formation of or substantially increase a nitrite level in the tobacco or a tobacco product. Nitrites in tobacco can have a potential for forming nitrosamines (TSNAs) in the tobacco and/or the tobacco product before, during, and/or after manufacturing.

Tobacco

The stabilization processes provided herein can be applied to adult-consumer tobacco products, which can be manufactured in a variety of forms. Without limitation, adult-consumer tobacco products include smokeless tobacco products (e.g., MST), cigarette products, cigar products, loose tobacco, and tobacco-derived nicotine products. Representative smokeless tobacco products include, for example, chewing tobacco, snus, snuff (moist or dry), long cuts, fine cuts, pouches, films, tablets, sticks, rods, and the like. In at least one example embodiment, the smokeless tobacco product can include characteristics described in: U.S. Pat. No. 8,469,036, issued Jun. 25, 2013 (US 2005/0244521); U.S. Pat. No. 8,627,828, issued Jan. 4, 2014 (US 2006/0191548); U.S. patent application Ser. No. 13/086,082, filed Apr. 14, 2010 (US Pat. App. Pub. No. 2012/0024301), U.S. Pat. No. 8,978,661, issued Mar. 17, 2015 (US 2012/0031414); and/or U.S. Pat. No. 9,066,540, issued Jun. 30, 2015 (US 2012/0031416), the entire contents of each of which are incorporated herein by this reference thereto.

In at least one example embodiment, the stabilization methods provided herein can be applied to any various unfinished forms of tobacco. Unfinished forms of tobacco can include any form of tobacco that has not been final-packaged. In at least one example embodiment, the methods described herein can be applied to unfinished forms of tobacco, such as undried tobacco, dried or cured tobacco, unfermented tobacco, fermented tobacco, heat treated or pasteurized tobacco, partially processed tobacco, unprocessed tobacco, raw tobacco, or any combinations thereof.

By "tobacco fibers" it is meant a part, e.g., leaves, and stems, of a member of the genus *Nicotiana* that cut, shredded, or otherwise processed to form fibers of *Nicotiana* plant tissue. Exemplary species of *Nicotiana* include *N. rustica, N. tabacum, N. tomentosifotmis*, and *N. sylvestris*. For example, the tobacco fibers can be made by comminuting tobacco stems. The tobacco fibers can include cellulose, lignin, lipids, hemicellulose, and other tobacco constituents.

In at least one example embodiment, tobacco stabilized as described herein can be a processed tobacco. Tobacco processing can include pre-conditioning, pasteurizing, curing, and/or fermenting. Pre-conditioning includes, for example, a heating, sweating or pasteurization step as described in U.S. patent application Ser. No. 10/322,469, filed Dec. 19, 2002 (US Pat. App. Pub. No. 2004/0118422) and/or U.S. Pat. No. 7,694,686, issued Apr. 13, 2010 (US Pat. Appl. Pub. No. 2005/0178398), the entire contents of each of which are incorporated herein by this reference thereto.

Fermenting may generally be characterized by high initial moisture content, heat generation, and a loss of dry weight ranging from about 10% to about 20%. In at least one example embodiment, fermenting may include processes described in U.S. Pat. No. 4,528,993, issued Jul. 16, 1985; U.S. Pat. No. 4,660,577, issued Apr. 28, 1987; U.S. Pat. No. 4,848,373, issued Jul. 18, 1989; and/or 5,372,149, issued Dec. 13, 1994, the entire contents of each of which are incorporated herein by this reference thereto. In addition to modifying the taste, aroma, and/or flavor of the leaf, fermentation can change the appearance and/or the texture of the leaf. During the fermentation process, evolution gases can be produced, oxygen can be taken up, the pH can change, and the amount of retained water can change. See, for example, U.S. Pat. No. 7,694,686, issued Apr. 13, 2010 (US Pat. App. Pub. No. 2005/0178398) and/or Tso (1999, Chapter 1 in Tobacco, Production, Chemistry and Technology, Davis & Nielsen, eds., Blackwell Publishing, Oxford), the entire contents of each of which are incorporated herein by this reference thereto. Cured, or cured and fermented tobacco can be further processed (e.g., cut, expanded, blended, milled or comminuted). See, for example, U.S. Pat. No. 4,528,993 as described above; U.S. Pat. No. 4,660,577 as described above; and U.S. Pat. No. 4,987,907, issued Jan. 29, 1991), the entire contents of each of which are incorporated herein by this reference thereto The methods described herein can be applied to tobacco that has been prepared from plants having less than about 20 μg of DVT per $cm^2$ of green leaf tissue. In at least one example embodiment, the tobacco fibers can be selected from the tobaccos described in U.S. Pat. No. 8,168,855 (Pat. App. Pub. No. 2008/0209586), the entire contents of each of which is incorporated herein by this reference thereto. Tobacco compositions containing tobacco from such low-DVT varieties exhibit improved taste, flavor, and/or aroma characteristics in sensory panel evaluations when compared to tobacco or tobacco compositions that do not have reduced levels of DVTs.

The stabilization methods described herein can be applied to leaf tobacco that has been cured using conventional means, e.g., flue-cured, barn-cured, fire-cured, air-cured or sun-cured before or after aging. See, for example, Tso (1999, Chapter 1 in Tobacco, Production, Chemistry and Technology, Davis & Nielsen, eds., Blackwell Publishing, Oxford) for a description of different types of curing methods. Cured tobacco is usually aged in a wooden drum (i.e., a hogshead) or cardboard cartons in compressed conditions for several years (e.g., a duration ranging from about two to about five years), at a moisture content ranging from about 10% to about 25%. See, U.S. Pat. No. 4,516,590, issued May 14, 1985; and/or U.S. Pat. No. 5,372,149, as described above. Cured and aged tobacco then can be further processed. Further processing may include conditioning the tobacco under vacuum with or without the introduction of steam at various temperatures, pasteurization, and fermentation.

Any one of the example embodiments of the methods described herein can be applied to any tobacco fiber that has been processed to a desired (or, alternatively predetermined) size. In example embodiments, the tobacco fiber can be processed to have an average fiber size of less than about 200 micrometers. In at least one example embodiment, the fibers have a size ranging from about 75 to about 125 micrometers. In other example embodiments, the fibers are processed to have a size of less than or equal to about 75 micrometers.

Suitable tobacco fibers can include shredded, fine-cut, double-cut, or long-cut tobacco. In at least one example embodiment, the tobacco fibers include long cut tobacco, which can be cut or shredded into widths ranging from about 10 cuts to about 110 cuts per inch and lengths ranging from about 0.1 to about 1 inch. Double-cut tobacco fibers can have a range of particle sizes such that about 70% of the double-cut tobacco fibers fall between the mesh sizes of −20 mesh and 80 mesh.

In at least one example embodiment, the tobacco is long-cut moist tobacco having an oven volatiles content ranging from about 20 to about 60 weight percent prior to mixing with other ingredients, and optionally flavorants and other additives.

In at least one example embodiment, the tobacco is fine-cut moist tobacco having an oven volatiles content ranging from about 20 to about 60 weight percent prior to mixing with other ingredients, and optionally flavorants and other additives.

In at least one example embodiment, the tobacco is pouched moist tobacco having an oven volatiles content ranging from about 30 to about 60 weight percent prior to mixing with other ingredients, and optionally flavorants and other additives.

In at least one example embodiment, the tobacco is chewing tobacco having an oven volatiles content ranging from about 30 to about 60 weight percent prior to mixing with other ingredients, and optionally flavorants and other additives.

In at least one example embodiment, the tobacco is dry snuff having an oven volatiles content ranging from about 0 to about 10 weight percent prior to mixing with other ingredients, and optionally flavorants and other additives.

Stabilization Methods

In at least at least one example embodiment, the stabilization processes described herein include an application of at least one sterilization process. The sterilization process can be an electron beam (E-Beam) treatment (also referred to as cold pasteurization) applied to tobacco and/or finished tobacco products. E-Beam treatment is a form of sterilization in which high-energy electrons are directly applied to a material to reduce or eliminate microorganisms associated with the material. During E-Beam treatment, accelerated particles of electrons penetrate through the material and yield a partially or fully sterile tobacco by causing death of living organisms (e.g., microbes and/or insects) by breaking the chains of DNA in such living organisms present on and within the material. In at least one example embodiment, parameters of the tobacco during the stabilization method (e.g., E-Beam treatment) can affect the characteristics of the tobacco, such as an amount of nitrite in the tobacco, following the sterilization, as will be discussed in later sections.

In at least one example embodiment, E-Beam sterilization reduces microbes (e.g., bacterial cells, bacteria spores, mold, etc.) in tobacco products (e.g., MST) without changing the taste, aroma, flavor, and/or texture attributes of the tobacco product. In at least one example embodiment, the E-Beam sterilization process is applicable to both tobacco and tobacco products (e.g., MST) for providing reliable and/or extended microbial retail shelf life stability. In at least one example embodiment, the E-Beam treatment provides an effective method of disinfection and/or partial or full sterilization of tobacco and tobacco products. In at least some example embodiments, E-Beam treatment can provide a fast process (e.g., a process that is capable of being completed within minutes or seconds) and can be easily integrated into existing manufacturing (production) processes.

In at least one example embodiment, E-Beam sterilization may be comparatively quicker (e.g., capable of being completed within minutes or seconds), and implemented easily in existing manufacturing or production streams. Furthermore, E-Beam sterilization may generate reduced levels of oxidation, as compared to gamma radiation treatments. In at least one example embodiment, oxidation may be undesirable because it may negatively affect the taste, flavor, aroma, appearance, and/or texture of the finished tobacco product. Furthermore, E-Beam processing may provide a more convenient method of sterilization as it does not require the use of any radioactive source. In at least one example embodiment, E-Beam sterilization includes easy-to-implement equipment, which facilitates quick and simple (manufacturing) workflow integration.

FIG. 1 provides an illustration of an example stabilization method 100 for stabilizing tobacco products 10. In at least one example embodiment, the process 100 includes an E-Beam accelerator system 110, which contains an electron gun generator 120, an accelerator tube 130, and a scan horn 140. The electron gun generator 120 generates high-energy beta electrons (depicted by arrows) for eliminating or reducing microbes and/or insects. The accelerator tube 130 is a tubular housing that extends away from the electron gun generator 120 to toward the scan horn 140, providing a pathway for high-energy electrons to accelerate as the electrons advance towards the scan horn 140. The scan horn 140 is a flared outlet end configured to increase distribution of the electrons. In at least one example embodiment, the E-Beam accelerator system 110 can be placed above a conveyor belt 150 during manufacturing, such that product 10 being conveyed can be sterilized while under the scan horn 140 of the system 100.

Figure 2:
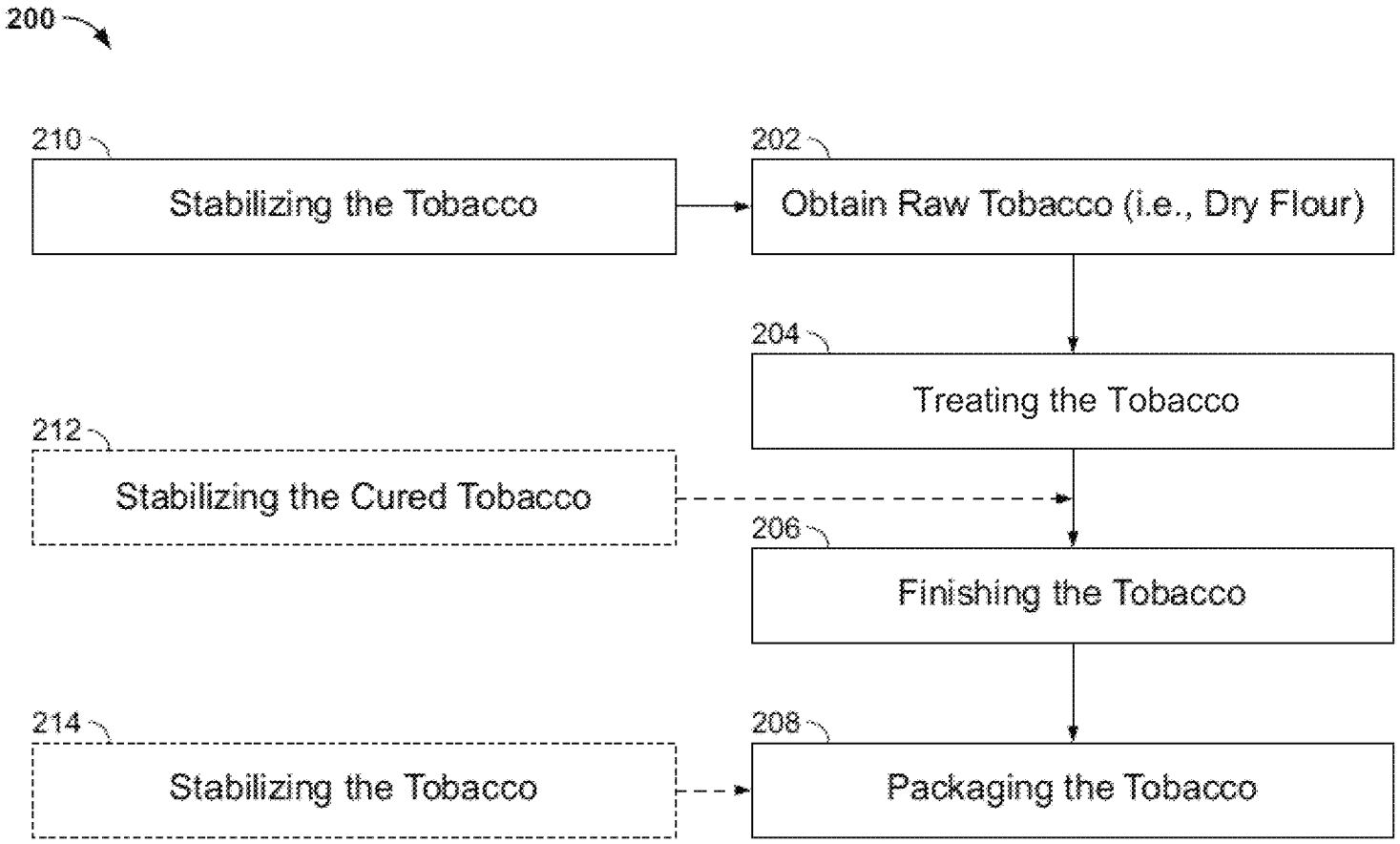
FIG. 2 is a flow diagram of a tobacco manufacturing process according to at least one example embodiment.

FIG. 2 provides a flow chart showing a method 200 for manufacturing a tobacco product. In at least one example embodiment, the method 200 includes obtaining raw tobacco 202, treating the tobacco 204, finishing the tobacco 206, and packaging the tobacco 208 to form a final tobacco product. The tobacco obtained in step 202 can include any of the forms of tobacco described herein, for example, processed, unprocessed, and/or raw tobacco. The treatment process 204 can include performing any of the pre-conditioning, pasteurizing, curing, and/or fermentation methods described herein. The finishing step 206 can include incorporating and shaping (if applicable) the treated tobacco into a final product form, such as a chewable oral product, a dissolvable oral product, a tobacco gum, chewing tobacco, dry snuff, and moist snuff. The finishing step may include mixing the fermented tobacco with other ingredients that include, but are not limited to, additives, fillers, flavorants, and the like. The packaging step 208 can include inserting the final tobacco product or products into an appropriate package, such as a pouch, can, box, bag, or the like.

One or more of the stabilizing methods described herein can be performed at any time during the manufacturing process 200. In at least one example embodiment, the stabilizing methods described herein can be performed during the obtaining step 202, or shortly thereafter (see step 210). In at least one example embodiment, the stabilizing processes can be performed after treatment (e.g., pre-conditioning, curing, fermentation), but prior to the finishing step (see step 212). In at least some example embodiments, at least one of the stabilizing processes can be applied during the packaging, or after the tobacco product has been packaged (see step 214). In at least some example embodiments, one or more stabilizing processes can be applied once, or more than once during the manufacturing process (e.g., two, three, four, five, or more than five times). For example, in at least one example embodiment, a first stabilizing process can be performed during the obtaining step 202 and a second stabilizing process is performed during or after the packaging step (see steps 210 and 214).

In at least one example embodiment, the E-Beam sterilization process may be performed on processed, unprocessed, stored, and/or raw tobacco as an alternative disinfestation method for reducing or eliminating tobacco insects in the tobacco. In at least one example embodiment, the E-Beam treatments described herein can yield tobacco products having reliable and/or extended retail shelf life stability as well as disinfested (e.g., raw or stored) tobacco. In at least one example embodiment, the E-Beam treatments described herein can provide an alternative disinfestation method for treating infested tobacco, and/or for replacing or supplementing applications of chemical fumigants.

Treatment Dosage

The electron energies of the E-Beam treatments described herein can be adjusted, as desired, when performed on tobacco and/or tobacco products such that key characteristics of the tobacco are not impacted. The electron energies of E-Beam treatment can vary from the keV to MeV range to target a desired depth of penetration during the E-Beam processing. The E-Beam treatment dosage can be measured in Gray (Gy) or Rad units, where 1 Gy is equivalent to 100 Rad. In at least one example embodiment, the stabilizing method can include applying a minimum and/or reduced treatment dosage of about 3 kGy. In at least one example embodiment, the minimum and/or reduced treatment dosage may be greater than or equal to about 4, optionally greater than or equal to about 5, optionally greater than or equal to about 6, optionally greater than or equal to about 7, optionally greater than or equal to about 8, optionally greater than or equal to about 9, optionally greater than or equal to about 10, optionally greater than or equal to about 13, optionally greater than or equal to about 15, optionally greater than or equal to about 20, optionally greater than or equal to about 25, optionally greater than or equal to about 30, or optionally greater than or equal to about 35 kGy. The minimum effective treatment dosage corresponds to a dosage sufficient to permit the electrons to penetrate through an object and yield a sterilized product having a decreased quantity of microbes per gram when compared to an untreated product. In at least one example embodiment, the stabilizing process includes applying a maximum and/or increased treatment dosage that does not exceed about 35 kGy. In at least one example embodiment, the maximum and/or increased treatment dosage may be less than or equal to about 35 kGy, optionally less than or equal to about 30 kGy, optionally less than or equal to about 25 kGy, optionally less than or equal to about 20 kGy, optionally less than or equal to about 15 kGy, optionally less than or equal to about 13 kGy, optionally less than or equal to about 10 kGy, optionally less than or equal to about 9 kGy, optionally less than or equal to about 8 kGy, optionally less than or equal to about 7 kGy, optionally less than or equal to about 6 kGy, and optionally less than or equal to about 5 kGy. The maximum and/or increased effective treatment dosage corresponds to a dosage sufficient to ensure that the E-Beam treatment does not compromise a final tobacco product having a desirable composition, taste, aroma, flavor, texture, and/or appearance. In at least one example embodiment, the stabilizing process includes applying a treatment dosage that ranges from about 2 kGy to about 35 kGy. For example, the treatment dosage may range from about 3 kGy to about 35 kGy, about 5 kGy to about 35 kGy, about 7 kGy to about 35 kGy, about 10 kGy to about 35 kGy, about 15 kGy to about 20 kGy, about 25 kGy to about 35 kGy, about 30 kGy to about 35 kGy, about 3 kGy to about 30 kGy, about 5 kGy to about 30 kGy, about 7 kGy to about 30 kGy, about 10 kGy to about 30 kGy, about 15 kGy to about 30 kGy, about 20 kGy to about 30 kGy, about 25 kGy to about 30 kGy, about 8 kGy to about 18 kGy, or about 10 kGy to about 15 kGy.

Treatment Duration

Tobacco and/or tobacco products may be treated using one or more stabilizing processes (e.g., E-Beam treatment) for a desired (or, alternatively predetermined) duration to achieve a desired level of disinfection and/or sterilization. In at least one example embodiment, the stabilizing process includes applying a treatment dosage to the tobacco or the tobacco product for about one second or less. In at least one example embodiment, the treatment dosage can be applied for a longer duration of greater than 1 second. For example, the treatment dosage may be applied for a duration of greater than or equal to about 2 seconds, optionally greater than or equal to about 3 seconds, optionally greater than or equal to about 4 seconds, optionally greater than or equal to about 5 seconds, optionally greater than or equal to about 10 seconds, optionally greater than or equal to about 15 seconds, optionally greater than or equal to about 20 seconds, optionally greater than or equal to about 30 seconds, optionally greater than or equal to about 40 seconds, optionally greater than or equal to about 50 seconds, or optionally greater than or equal to about 60 seconds. In at least one example embodiment, the stabilizing process includes applying a treatment dosage to the tobacco or the tobacco product for a duration of at least 1 minute. In at least one example embodiment, the treatment dosage can be applied for a duration of greater than or equal to about 2 minutes, optionally greater than or equal to about 3 minutes, optionally greater than or equal to about 4 minutes, optionally greater than or equal to about 5 minutes, optionally greater than or equal to about 10 minutes, optionally greater than or equal to about 15 minutes, optionally greater than or equal to about 20 minutes, optionally greater than or equal to about 30 minutes, optionally greater than or equal to about 40 minutes, optionally greater than or equal to about 50 minutes, or optionally greater than or equal to about 60 minutes. In at least one example embodiment, the stabilizing process includes applying a treatment dosage to the tobacco or the tobacco product for a duration of at least 1 hour. For example, the treatment dosage can be applied for a duration of greater than or equal to about 2, optionally greater than or equal to about 3, optionally greater than or equal to about 4, or optionally greater than or equal to about 5 hours. The effective treatment duration corresponds to a duration sufficient to ensure that the electrons penetrate through an object to yield a sterile product. In at least one example embodiment, one or more stabilizing processes apply a desired treatment dosage for less than or equal to 1 second. In at least one example embodiment, the treatment dosage may be applied for a duration of no more than about a minute. In at least one example embodiment, the treatment dosage may be applied for a duration of less than or equal to about 60 seconds, optionally less than or equal to about 50 seconds, optionally less than or equal to about 40 seconds, optionally less than or equal to about 30 seconds, optionally less than or equal to about 20 seconds, optionally less than or equal to about 10 seconds, optionally less than or equal to about 5 seconds, optionally less than or equal to about 4 seconds, optionally less than or equal to about 3 seconds, and optionally less than or equal to about 2 seconds. In at least one example embodiment, one or more stabilizing processes may apply a desired treatment dosage for no more than about 1 hour. In at least one example embodiment, the treatment dosage may be applied for a duration of less than or equal to about 60 minutes, optionally less than or equal to about 50 minutes, optionally less than or equal to about 40 minutes, optionally less than or equal to about 30 minutes, optionally less than or equal to about 20 minutes, optionally less than or equal to about 15 minutes, optionally less than or equal to about 10 minutes, optionally less than or equal to about 5 minutes, optionally less than or equal to about 4 minutes, optionally less than or equal to about 3 minutes, and optionally less than or equal to about 2 minutes. In at least one embodiment, one or more stabilizing processes apply a desired treatment dosage for a duration of greater than an hour. In at least one example embodiment, one or more stabilizing processes may be applied for less than or equal to 5 hours, optionally less than or equal to about 4 hours, optionally less than or equal to about 3 hours, and optionally less than or equal to about 2 hour. The maximum effective treatment duration corresponds to a duration sufficient ensure that the treatment does not substantially compromise the composition, taste, aroma, flavor, texture, and/or appearance of the tobacco or the tobacco product.

In at least one example embodiment, the tobacco and/or the tobacco products can be exposed to the E-Beam treatment for a desired (or, alternatively predetermined) duration ranging from about 0.1 seconds to about 5 hours. In at least one example embodiment, the desired (or, alternatively predetermined) duration ranges from about 0.1 seconds to about 1 second, from about 1 second to about 10 seconds, from about 10 seconds to about 30 seconds, from about 30 seconds to about 60 seconds, from about 1 minute to about 5 minutes, from about 5 minutes to about 10 minutes, from about 10 minutes to about 15 minutes, from about 15 minutes to about 20 minutes, from about 20 minutes to about 25 minutes, from about 30 minutes to about 60 minutes, from about 1 hour to about 2 hours, from about 2 hours to about 3 hours, from about 3 hours to about 4 hours, or from about 4 hours to about 5 hours.

The E-Beam treatments can be performed using an IMPELA E-Beam accelerator (supplied by Iotron Industries, Columbia City, IN) at 10 MeV (and 60 kW), or at 5 MeV, for example.

The E-Beam treatment is generally applied at non-elevated temperatures, such as about room temperature (approximately 25° C.). In at least one example embodiment, the E-Beam treatment can be applied to tobacco or tobacco products under slightly elevated or slightly decreased temperatures (temperatures ranging from about 10° C. to about 40° C., optionally temperatures ranging from about 20° C. to about 30° C.) in which the temperature would not negatively impact the quality of the tobacco.

In at least one example embodiment, the E-Beam treatment may be performed within an environment containing an inert atmosphere. In at least one example embodiment, tobacco products or unfinished tobacco can be stabilized with the E-Beam treatment in a nitrogen atmosphere.

In at least one example embodiment, alternative forms of sterilization may be applied to tobacco and tobacco products for partial or full sterilization, and/or partial or full disinfecting. Other exemplary forms of sterilization may include, but are not limited to, autoclaving, treatment with ethylene oxide, gamma irradiation, x-ray treatments, and high-pressure treatments. Although other forms of sterilization are available, these types of sterilization can negatively impact the quality of goods, such as tobacco, due to pressure, oxidative, and/or temperature-caused degradation.

Conditioning Process

In at least one embodiment, the stabilizing methods described herein can include performing a conditioning process to the tobacco and/or the tobacco products prior to and/or during stabilization (e.g., E-Beam treatment) of the tobacco and the tobacco products. In at least one example embodiment, a conditioning process may be modified (or altered) to obtain a desired characteristic of the tobacco and/or tobacco product (e.g., pH and/or moisture content of the tobacco and/or tobacco product) before and/or during the E-Beam treatment.

In at least one example embodiment, subjecting tobacco to a conditioning process before and/or during the E-Beam treatment (sterilization) can affect key characteristics, for example, the amount of nitrite, in the tobacco during and after sterilization. Prevention and/or reduction of the formation of the amount of nitrite in tobacco and tobacco products may occur in at least one example embodiment, as nitrites can have a potential of forming tobacco-specific nitrosamines (TSNAs) in the tobacco and the tobacco product. Representative TSNAs include, without limitation, N'-nitrosonornicotine (NNN), 4-(N-nitrosomethylamino)-1-(3-pyridyl)-1-butanone (NNK), N'-nitrosoanatabine (NAT) and N'-nitrosoanabasine (NAB). Negligible amounts of TSNAs are typically present in freshly harvested green tobacco. TSNAs are mainly formed during drying of tobacco in a barn (curing) and can also be formed during storing, manufacturing of a tobacco product and throughout retail shelf life of the product within the package. TSNAs are formed as a result of the nitrosation of tobacco alkaloids in the presence of nitrite and nitrogen oxides (NOx). For example, NNN is formed by the nitrosation of nornicotine, an alkaloid.

The sterilization processes can, in certain circumstances, form nitrites in tobacco under specific conditions. Certain sterilization methods, such as the E-Beam treatment, may generate nitrite in the tobacco when specific tobacco conditions are not present. Accordingly, in at least one example embodiment, the stabilization methods described can result in partial or full sterilization of the tobacco without affecting (e.g., increasing) the levels of nitrites in the tobacco and/or a tobacco product.

In at least one example embodiment, the stabilizing does not cause the formation of nitrates or cause a substantial increase in a nitrate level in the tobacco or the tobacco product. In at least one example embodiment, the tobacco has a first nitrate level prior to stabilizing the tobacco and a second nitrate level after stabilizing the tobacco. A difference between the second nitrate level and the first nitrate level is less than or equal to about 300 μg of nitrite per gram of dry tobacco, optionally less than or equal to about 150 micrograms of nitrite per gram of dry tobacco, and optionally less than or equal to about 10 μg of nitrite per gram of dry tobacco. In at least one example embodiment, the first and second nitrate levels are substantially equal.

Conditioning processes described herein can be applied to a variety of tobacco products. In at least one example embodiment, the conditioning processes described herein can be applied to a consumable product (e.g., MST). In at least one example embodiment, the conditioning processes can be applied to any tobacco product, including, but not limited to, chewable oral products, dissolvable oral products, tobacco gums, chewing tobaccos, dry snuff, and moist snuff.

In at least one example embodiment, the conditioning process is configured to be performed on various forms of tobacco, including any of the tobacco forms provided herein. For example, in some embodiments, the stabilizing processes described herein can be applied to unfinished forms of tobacco, such as processed, unprocessed, stored and/or raw tobacco fibers.

In at least one example embodiment, the one conditioning process is configured to maintain, or modify (e.g., reduce or increase) the oven volatiles content (or moisture content) of the tobacco and/or tobacco product. As used herein, "oven volatiles" are determined by calculating the percentage of weight loss from a sample after drying the sample in a pre-warmed forced draft oven at 110° C. for 3.25 hours.

In at least one example embodiment, tobacco fibers can have an oven volatiles content of greater than or equal to about 5% by weight, optionally greater than or equal to about 10% by weight, optionally greater than or equal to about 20% by weight, optionally greater than or equal to about 40% by weight or greater. In at least one example embodiment, the tobacco fibers have a total oven volatiles content ranging from about 15% by weight to about 25% by weight, optionally about 20% by weight to about 30% by weight, optionally about 30% by weight to about 50% by weight, optionally about 45% by weight to about 65% by weight, and optionally about 50% by weight to about 60% by weight. Those of skill in the art will appreciate that "moist" tobacco typically refers to tobacco that has an oven volatiles content ranging from about 40% by weight to about 60% by weight, optionally about 45% by weight to about 55% by weight, and optionally about 50% by weight.

Adjusting the Oven Volatile Content of the Tobacco Fibers

Any form of tobacco (e.g., raw, processed, or unprocessed tobacco) can be subjected to one or more conditioning processes. In at least one embodiment, the conditioning process is configured to adjust the oven volatile content of the tobacco to greater than or equal to about 5% by weight, optionally greater than or equal to about 10% by weight, optionally greater than or equal to about 20% by weight, optionally greater than or equal to about 40% by weight or greater. In at least one embodiment, the conditioning process is configured to adjust the oven volatile content of the tobacco to a value ranging from about 15% by weight to about 25% by weight, optionally about 20% by weight to about 30% by weight, optionally about 30% by weight to about 50% by weight, optionally about 45% by weight to about 65% by weight, and optionally about 50% by weight to about 60% by weight.

In at least one example embodiment, a tobacco product can have different overall oven volatiles content than the oven volatiles content of the tobacco fibers used to make a tobacco product. Any form of tobacco product (e.g., chewable oral products, dissolvable oral products, tobacco gum, chewing tobacco, dry snuff, and/or moist snuff) can be subjected to one or more conditioning processes. In at least one example embodiment, the conditioning process may be configured to adjust the oven volatile content of the tobacco product to about greater than or equal to about 2% by weight, optionally greater than or equal to about 5% by weight, optionally greater than or equal to about 10% by weight, optionally greater than or equal to about 20% by weight, and optionally greater than or equal to about 40% by weight. In at least one example embodiment, the conditioning process may be configured to adjust the total oven volatile content to a value ranging from about 15% by weight to about 25% by weight, optionally about 20% by weight to about 30% by weight, optionally about 30% by weight to about 50% by weight, optionally about 45% by weight to about 65% by weight, and optionally about 50% by weight to about 60% by weight.

Adjusting and/or Maintaining the pH of the Tobacco Fibers and Tobacco Products

In at least one example embodiment, the conditioning process may be configured to maintain, or modify (e.g., reduce or increase) the pH level of the tobacco and/or the tobacco product. Tobacco fibers and tobacco products can be maintained at or adjusted to have a pH of about greater than or equal to about 2, optionally greater than or equal to about 3, optionally greater than or equal to about 4, optionally greater than or equal to about 5, optionally greater than or equal to about 6, optionally greater than or equal to about 7, optionally greater than or equal to about 8, optionally greater than or equal to about 9, optionally greater than or equal to about 10, and optionally greater than or equal to about 11.

In at least one example embodiment, tobacco fibers and tobacco products can be maintained at, or adjusted, to have a pH of less than or equal to about 11, optionally less than or equal to about 10, optionally less than or equal to about 9, optionally less than or equal to about 8, optionally less than or equal to about 7, optionally less than or equal to about 6, optionally less than or equal to about 5, optionally less than or equal to about 4, optionally less than or equal to about 3, and optionally less than or equal to about 2.

In at least one example embodiment, tobacco fibers and tobacco products can be maintained at, or adjusted, to have a pH ranging from about 2 to about 10, optionally from about 3 to about 8, optionally from about 4 to about 7, and optionally from about 5 to about 6. In some example embodiments, tobacco fibers and tobacco products can be maintained at, or adjusted, to have a pH of about 2, optionally about 3, optionally about 4, optionally about 5, optionally about 6, optionally about 7, optionally about 8, optionally about 9, and optionally about 10.

The pH value of tobacco can be modified by adding a pH buffering agent to the tobacco. In some example embodiments, the pH buffering agent includes one or more alkalizing agents, or one or more acidifying agents. As used herein, the term "alkalizing agent" is a compound used to provide an alkaline medium. Such compounds can include without limitation, ammonia solution, ammonium carbonate, diethanolamine, monoethanolamine, potassium hydroxide, sodium borate, sodium carbonate, sodium bicarbonate, sodium hydroxide, triethanolamine, trolamine, or combinations thereof. As used herein, the term "acidifying agent" is as a compound used to provide an acidic medium. Such compounds include without limitation, acetic acid, amino acid, citric acid, fumaric acid and other alpha-hydroxy acids, hydrochloric acid, ascorbic acid, nitric acid, or combinations thereof.

EXAMPLES

Example 1

Three exemplary finished tobacco products having a pH=7.8 and oven volatiles ranging from about 55.8 to about 57.1% were subjected to different dosage intensities using the E-Beam treatment as described herein, and microbiologically tested. The tobacco products included Product A (Snuff Tobacco), Product B (Long-Cut Tobacco), and Product C (Long-cut Tobacco). Samples from each of the three products were stabilized using six different E-Beam dosage conditions, including 1) 0 kGy (i.e., a "no dose" condition); 2) 5 kGy; 3) 10 kGy; 4) 15 kGy; 5) 25 kGy; and 6) 35 kGy.

A set of test group samples included the three different products, each stabilized with the E-Beam treatment at the various treatment dosages of 5 kGy, 10 kGy, 15 kGy, 25 kGy, and 35 kGy for approximately 2-3 seconds. The test group was E-Beam sterilized with an IMPELA E-Beam accelerator at about 5-10 MeV, and 60 kW (supplied by Iotron Industries, Columbia City, IN).

A control group (identified in FIG. 3 as the "no dose" group) was not subjected to any E-Beam treatment. The control group included a sample of each of the three products.

The control group and the test group were microbiologically tested. The effectiveness of electron beam for eliminating a natural microbial population in the tobacco was determined using a microbiological test capable of detecting the presence (or absence) of any viable microorganisms in the tobacco. After the tobacco products were treated with the E-Beam treatment, 30 grams of each sample were aseptically suspended in 270 grams of a diluent containing a buffer and a peptone. Each sample was mixed with the diluent for approximately 3 minutes. After mixing, the suspension was filtered, diluted, and subsequently plated to enumerate any surviving microorganisms after the E-Beam treatment. Each dilution sample was plated on a solid microbiological culture media, which contained sufficient nutrients to support recovery and growth of any microorganisms in the sample. The plates were incubated for two weeks (or a desired time frame) in a microbiological incubator that was set to 32° C. After the two weeks, the plates were evaluated by visual inspection and/or by counting the number of visible microbial colonies grown on the surface of the plates. If counted, each counted colony on the plates was expressed as Log CFU per each gram of the tobacco sample. The efficacy of the E-Beam treatment at a specific dosage was determined by comparing the Log CFU values before and after the E-Beam treatment.

Figure 3:
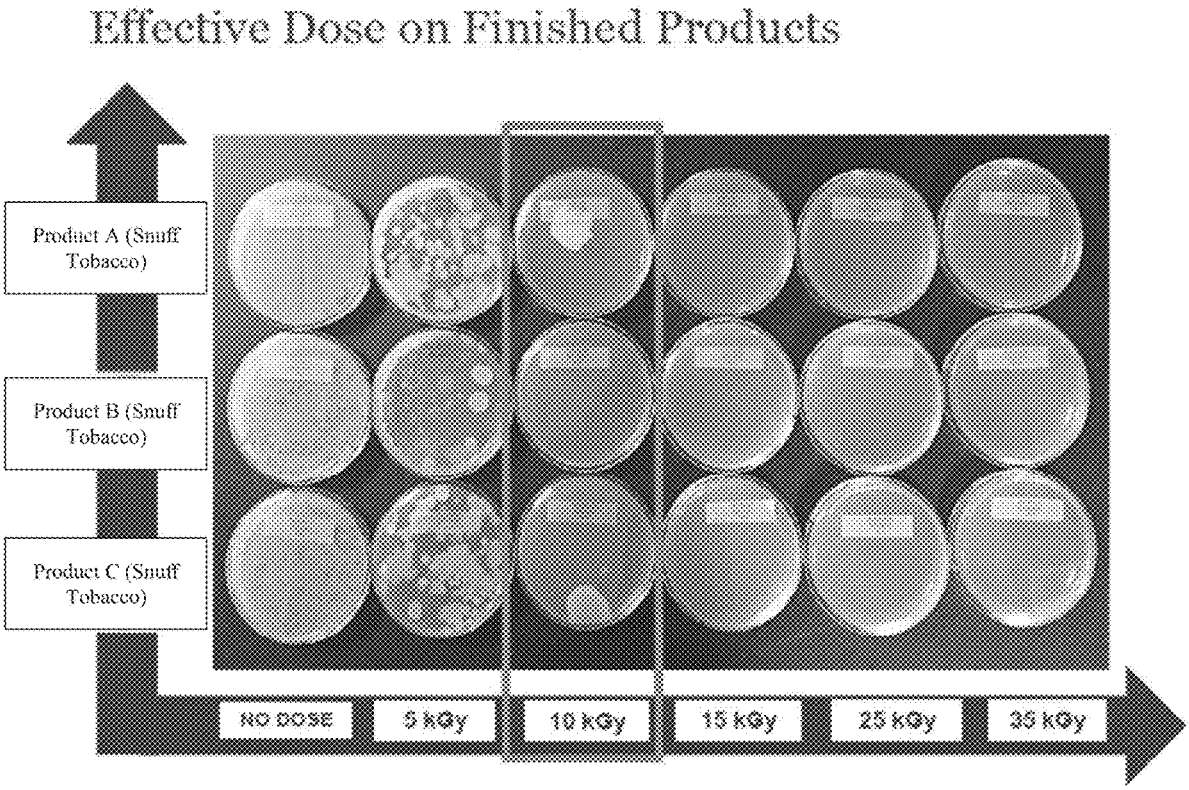
FIG. 3 provides images of microbial test results of finished tobacco products tested with different E-Beam treatment dosages according to at least one example embodiment.

FIG. 3 provides the microbial results of the three exemplary finished tobacco products subjected to the different E-Beam dosage intensities. The test results showed visible microbial growth in all of the control (no dose) group samples and the test group samples subjected to the treatment dose of 5 kGy. The test group samples subjected to 10 kGy showed some level of efficacy. In particular, Products A and C showed initial signs of microbial growth, while Product B showed no microbial growth.

Still referring to FIG. 3, all of the test group samples subjected to at least 15 kGy (including test group samples subjected to 15 kGy, 25 kGy and 35 kGy) showed no microbial growth.

Based on the results, at least 15 kGy was determined to be a sufficient dosage for preventing undesirable microbial growth in all of the products. Furthermore, the data showed that for certain tobacco products (e.g., Product B), at least 10 kGy can also be a sufficient dosage for preventing undesirable microbial growth.

Example 2

Different exemplary forms of dried raw (unfermented) tobacco were subjected to the E-Beam treatment described herein and tested microbiologically. Three different tobacco forms, which included Sample A (fine-cut, dried raw tobacco), Sample B (long-cut, dried raw tobacco), Sample C (undried, moist raw tobacco), having a pH of about 5.15, about 5.12, and about 5.38, and oven volatiles of about 5.31, about 4.97, and about 23.01%, respectively, were evaluated.

The test group, which included three different forms of tobacco, was subjected to the E-Beam treatment at various treatment dosages (10 kGy and 15 kGy) for approximately 2-3 seconds. The test group was E-Beam sterilized with an IMPELA E-Beam accelerator at 5-10 MeV, and 60 kW (supplied by Iotron Industries, Columbia City, IN).

A control group (identified in FIG. 4 as the "no dose" group), which included a sample of each of the three forms of tobacco, was not subjected to the E-Beam treatment.

The control group and the test group were tested using the microbiological test described herein.

Figure 4:
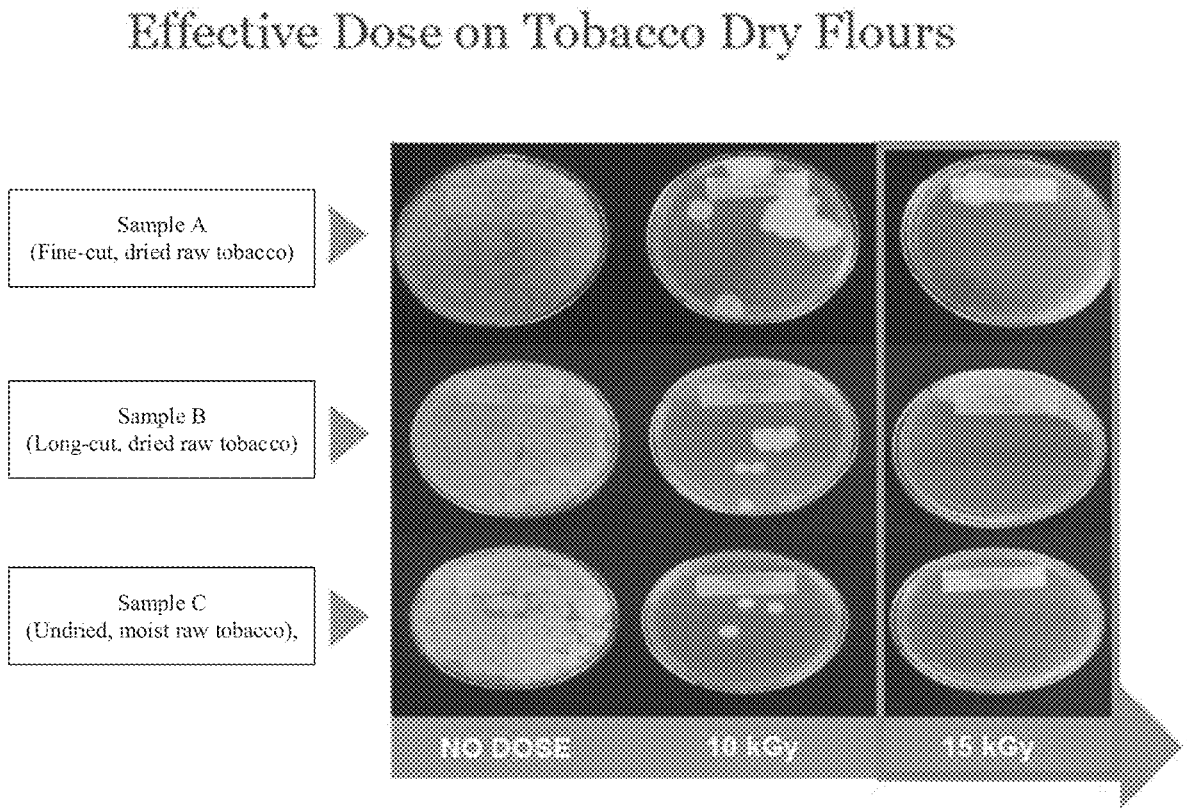
FIG. 4 provides images of microbial test results of tobacco tested with different E-Beam treatment dosages according to at least one example embodiment.

FIG. 4 shows microbial results of the different exemplary forms of the dried raw tobacco subjected to the E-Beam treatment. Signs of microbial growth were present in all of the samples of the control (no dose) group. Microbial growth was also visible in the test group samples that were subjected to the treatment dosage of 10 kGy.

As shown in FIG. 4, the test group samples subjected to the treatment dosage of 15 kGy showed some level of efficacy. Specifically, Sample B showed initial signs of microbial growth, while Samples A and C showed no microbial growth at 15 kGy.

The experimental results showed that different forms of the tobacco had different levels of microbial growth. Fine-cut and undried forms of tobacco, when subjected to the treatment dosage of 15 kGy or higher, showed no visible signs of microbial growth. The long-cut tobacco, however, showed visible microbial growth in both of the E-Beam dosage levels (10 and 15 kGy). The fine-cut and undried forms of tobacco, when subjected to E-Beam treatments dosages of 10 kGy or less, had significant levels of microbial growth.

Example 3

Exemplary fine-cut, dried raw (unfermented) tobaccos having a pH of about 5.15 and oven volatiles of about 5.31% conditioned with different oven volatiles contents (i.e., amounts of moisture) were subjected to different E-Beam treatment dosage levels and microbiologically tested.

Test and control samples of the tobacco were conditioned using methods discussed herein to achieve the moisture oven volatile content of 5, 15, and 25% by weight before being subjected to the E-Beam treatment.

The conditioned test samples of the tobacco were subjected to the E-Beam treatment at various treatment dosages (10 kGy and 15 kGy) for approximately 2-3 seconds. The test group was E-Beam-sterilized with an IMPELA E-Beam accelerator at 5 MeV (supplied by Iotron Industries, Columbia City, IN).

A control group (identified in FIG. 4 as the "no dose" group), which also included samples of the different conditioned tobaccos, was not subjected to the E-Beam treatment.

The control group and the test group were prepared using the microbiological test described herein and observed five weeks after the E-Beam treatment occurred.

Figure 5:
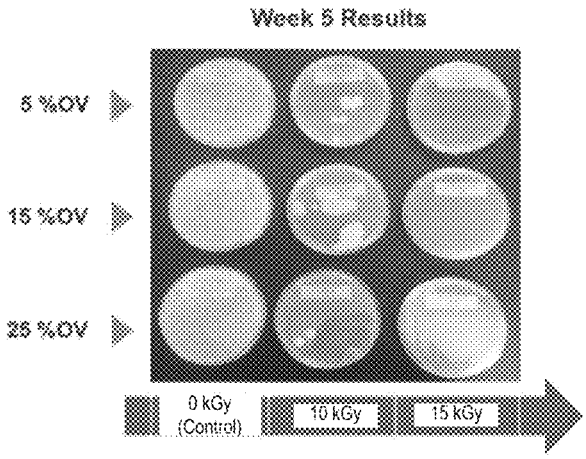
FIG. 5 provides images of microbial test results of fine-cut dried unfermented tobacco of varying oven volatile contents when subjected to different E-Beam treatment dosages according to at least one example embodiment.

FIG. 5 shows the results of the microbiological test. Visible microbial growth was present in all of the samples of the control (no dose) group as well as the test group samples subjected to the treatment dosage of 10 kGy.

The test group samples subjected to the treatment dosage of 15 kGy showed some level of efficacy. The test sample conditioned at the oven volatile content of 5% by weight showed initial signs of microbial growth, while the test samples conditioned at higher levels of moisture (i.e., oven volatile content of 15 and 25% by weight) showed no microbial growth.

The experimental results demonstrated that fine-cut, dried raw tobacco having at least an oven volatile content of 10% by weight, when subjected to the treatment dosage of 15 kGy or higher, showed no microbial growth, while all of the test samples subjected to lower E-Beam dosages 10 kGy) showed significant levels of microbial growth at all of the tested oven volatile levels.

Example 4

Exemplary long-cut, dried raw (unfermented) is tobacco having a pH of about 5.12 conditioned with different oven volatiles contents (i.e., amounts of moisture). The tobacco samples were subjected to different E-Beam treatment dosage levels and microbiologically tested.

Test and control samples of the tobacco were conditioned as discussed herein to obtain a moisture oven volatile content of 5%, 25%, and 45% by weight before being subjected to the E-Beam treatment.

The conditioned test samples of the tobacco were subjected to the E-Beam treatment at different treatment dosages (10 kGy and 15 kGy) for approximately 2-3 seconds using an IMPELA E-Beam accelerator at 5 MeV (supplied by Iotron Industries, Columbia City, IN).

A control group (identified in FIG. 4 as the "no dose" group), which also included samples of the conditioned tobacco, was not subjected to the E-Beam treatment.

The control group and the test group were prepared using the microbiological test described herein, and observed two weeks after the E-Beam treatment for microbial growth.

Figure 6:
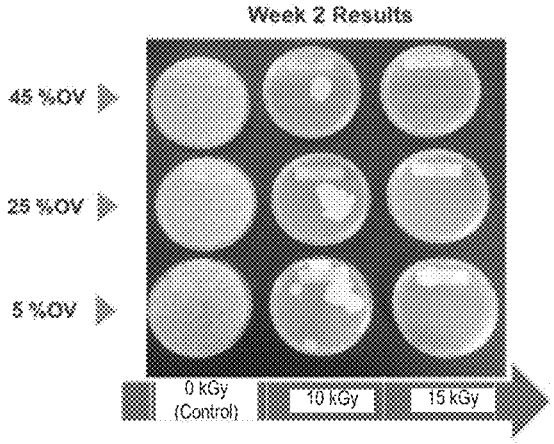
FIG. 6 provides images of microbial test results of long-cut dried unfermented tobacco of varying oven volatile contents when subjected to different E-Beam treatment dosages according to at least one example embodiment.

FIG. 6 shows the results of the microbiological test. The results showed visible microbial growth in all of the samples of the control (no dose) group as well as the test group samples subjected to the treatment dosage of 10 kGy.

None of the test group samples subjected to the treatment dosage of 15 kGy showed any signs of microbial growth.

The experimental results demonstrated that long-cut, unfermented tobacco, when subjected to the treatment dosage of 15 kGy or higher, showed no microbial growth, while all of the test samples subjected to lower E-Beam dosages 10 kGy) showed signs of microbial growth at each of the different volatile levels.

Example 5

Exemplary undried, unfermented tobacco having a pH of about 5.15 conditioned with different oven volatiles contents (i.e., amounts of moisture) were subjected to different E-Beam treatment dosage levels and microbiologically tested.

Test and control samples of the tobacco were conditioned using methods described herein to obtain the moisture oven volatile content of 25% and 45% by weight before being subjected to the E-Beam treatment.

The test samples of each of the conditioned tobaccos were subjected to the E-Beam treatment at different treatment dosages (10 kGy and 15 kGy) for approximately 2-3 seconds. The test group was E-Beam sterilized with an IMPELA E-Beam accelerator at 5 MeV (supplied by Iotron Industries, Columbia City, IN).

A control group (identified in FIG. 4 as the "no dose" group), which also included samples of the conditioned tobacco, was not subjected to the E-Beam treatment.

The control group and the test group were prepared using the microbiological test described herein, and observed two weeks after the E-Beam treatment for microbial growth.

Figure 7:
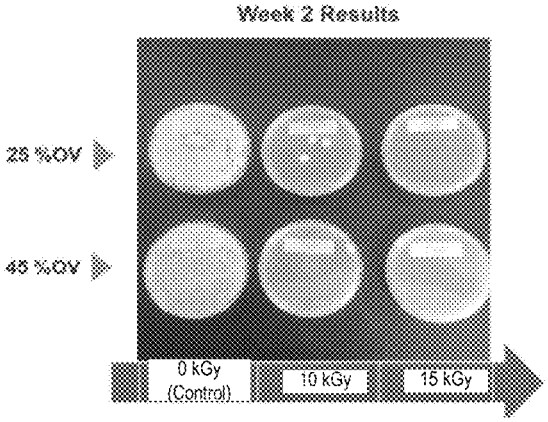
FIG. 7 provides images of microbial test results of undried unfermented tobacco of varying oven volatile contents when subjected to different E-Beam treatment dosages according to at least one example embodiment.

FIG. 7 shows the results of the microbiological test. The results showed visible microbial growth in all of the samples of the control (no dose) group.

The test group samples subjected to the treatment dosage of 10 kGy showed some level of efficacy. The test sample conditioned at the oven volatile content of 25% by weight showed initial signs of microbial growth, while the test sample conditioned at the higher oven volatile content of 40% by weight showed no microbial growth.

None of the test group samples subjected to the treatment dosage of 15 kGy showed signs of microbial growth.

The experimental results demonstrated that undried raw tobacco, when subjected to the treatment dosage of 15 kGy or higher, did not have visible microbial growth after two weeks. The results also showed that undried raw tobacco having a higher oven volatile (e.g., 40% OV), when subjected to a lower E-Beam dosage of 10 kGy, also does not have visible microbial growth.

Example 6

Different dried, unfermented tobaccos having a pH of about 5.15, about 5.12, and about 5.38, and oven volatiles of about 5.31, about 4.97, and about 23.01%, were subjected to different E-Beam treatment dosage levels and microbiologically tested at different time intervals.

Samples of the dried raw tobaccos included three tobacco types: 1) a fine-cut Tobacco A, 2) a long-cut Tobacco B, and 3) a long-cut Tobacco C. The samples of each tobacco type were subjected to the E-Beam treatment at different treatment dosages (5 kGy, 10 k Gy, 15 kGy, 25 kGy, and 35 kGy) for approximately 2-3 seconds. The test group was E-Beam sterilized with an IMPELA E-Beam accelerator at 5-10 MeV (supplied by Iotron Industries, Columbia City, IN).

A control group (identified in FIG. 4 as the "no dose" group), which included a sample of each of the three tobacco types, was not subjected to the E-Beam treatment.

The control group and the test group were prepared using the microbiological test described herein, and observed 4 weeks, 8 weeks, and 16 weeks after the E-Beam treatment for microbial growth.

Figure 8A:
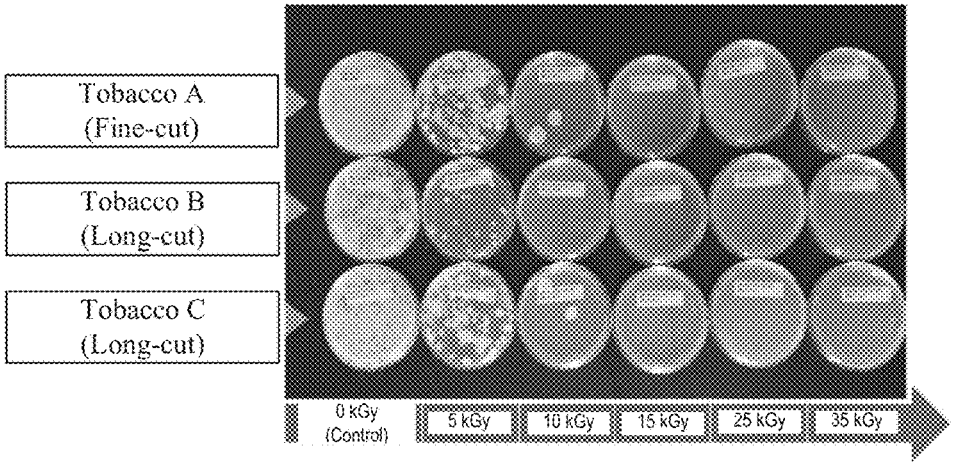
FIGS. 8A-8C show microbial results over time of dried unfermented tobaccos subjected to varying E-Beam treatment dosage levels according to at least one example embodiment.
Figure 8B:
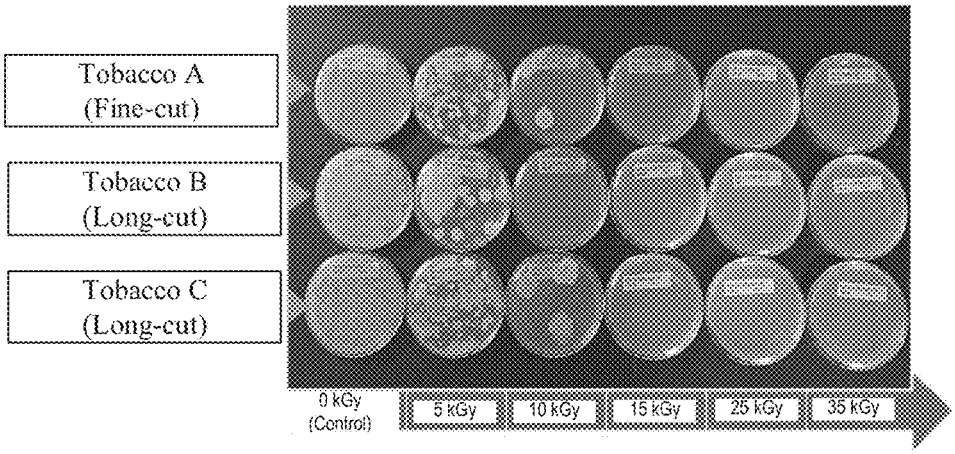
Figure 8C:
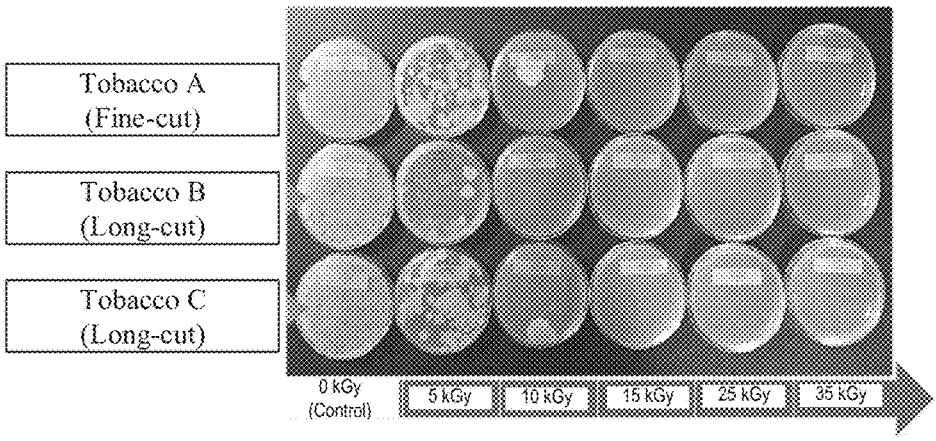

FIGS. 8A-8C show the microbial results over time of the different dried, unfermented tobaccos subjected to varying E-Beam treatment dosage levels.

Week 4

Four weeks after the E-Beam treatment, the results showed microbial growth in all of the samples of the control (no dose) group as well as the test group samples subjected to the 5 kGy dosage (see FIGS. 8A-8C).

The test group samples subjected to the treatment dosage of 10 kGy showed some level of efficacy. Tobacco A and Tobacco C showed initial signs of microbial growth, while Tobacco B showed no microbial growth.

All of the test group samples subjected to the treatment dosage of 15 kGy or higher (25 kGy and 35 kGy) showed no microbial growth.

Week 8

Eight weeks after the E-Beam treatment, the test group samples subjected to the treatment dosage of 10 kGy continued to show some level of efficacy (FIGS. 8A-8C). Tobacco A and Tobacco C showed increased signs of microbial growth, while Tobacco B continued to show no microbial growth.

All of the test group samples subjected to the treatment dosage of 15 kGy or higher (25 kGy and 35 kGy) continued to show no microbial growth.

Week 16

Sixteen weeks after the E-Beam treatment, the test group samples subjected to the treatment dosage of 10 kGy continued to show some level of efficacy (FIGS. 8A-8C). Tobacco A and Tobacco C showed increased signs of microbial growth, while Tobacco B continued to show no signs of microbial growth.

All of the test group samples subjected to the treatment dosage of 15 kGy or higher (25 kGy and 35 kGy) continued to show no microbial growth.

Example 7

Figure 9:
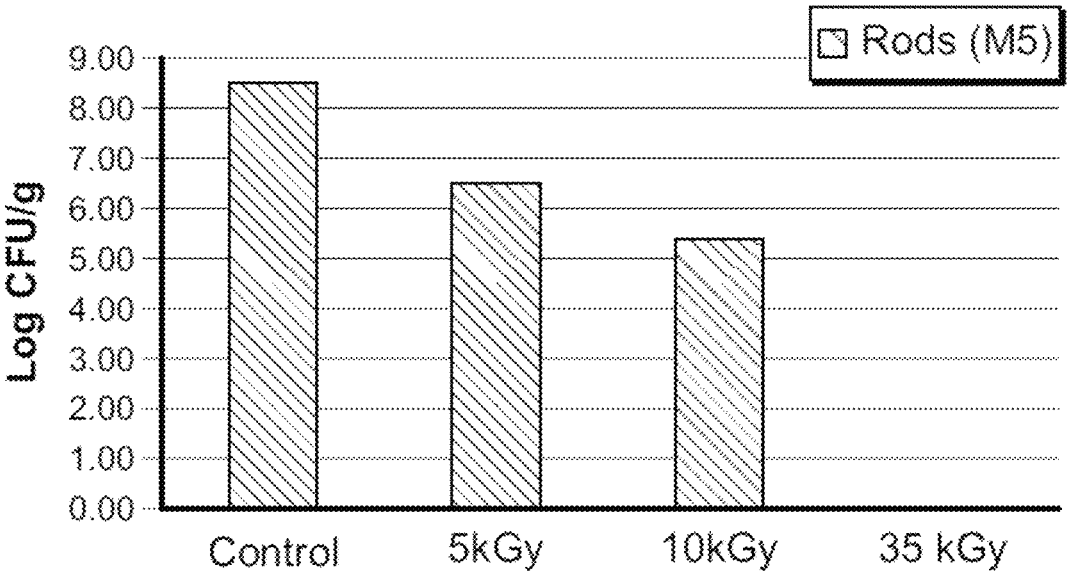
FIG. 9 is a graphical representation of microflora bacteria count in dried unfermented tobacco subjected to different E-Beam treatment dosage levels according to at least one example embodiment.

Exemplary dried, unfermented tobaccos having a pH=5.15 and oven volatiles of about 5.31% were subjected to different E-Beam treatment dosage levels. As shown in FIG. 9, a microflora bacteria count comparison of the exemplary tobaccos showed that increased E-Beam dosages resulted in a lower microbial counts.

Figure 10:
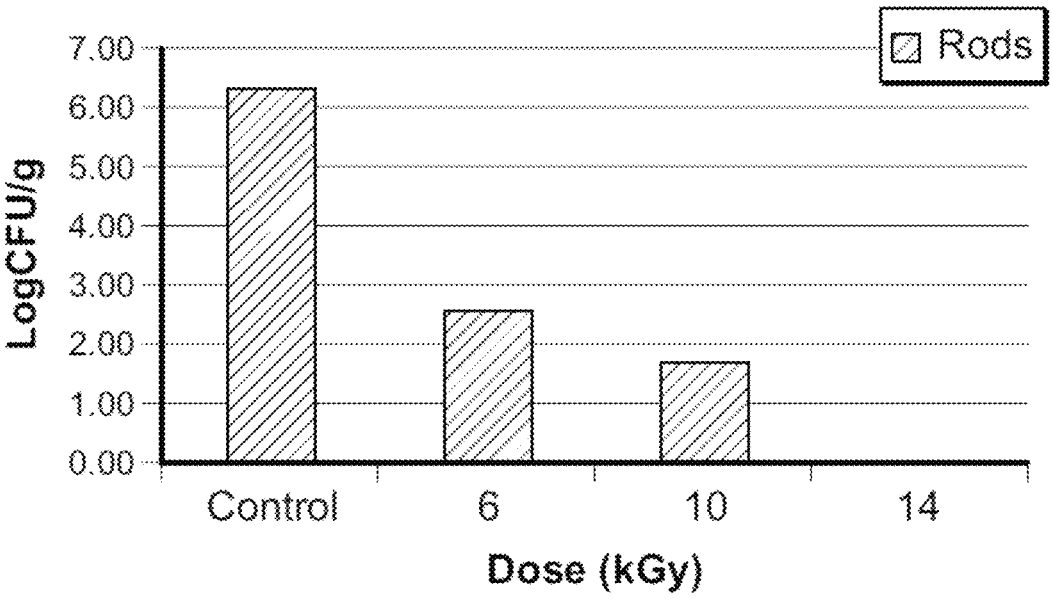
FIG. 10 is a graphical representation of microflora bacteria count in fine-cut finished product subjected to different E-Beam treatment dosage levels according to at least one example embodiment.

Finished products containing fine-cut tobacco having a pH of about 7.8 and oven volatiles of about 55.8% were also subjected to different E-Beam treatment dosage levels. As shown in FIG. 10, a microflora bacteria count comparison of the finished products showed that increased E-Beam dosages resulted in a lower microbial counts.

Example 8

Fine-cut, dried, unfermented tobaccos conditioned at different pH values were E-Beam treated at different treatment dosage levels and tested for nitrite content.

Various test and control samples of tobacco were conditioned with different pH buffers (e.g., sodium carbonate and ammonium carbonate) and having an oven volatile of about 45%. Sodium hydroxide (NaOH) buffering agent was used to achieve a pH of 5, 7 or 8 prior to the E-Beam treatment. The test samples included: Sample 1: A control tobacco at a pH of 5 and oven volatiles of about 45%; Sample 2: A control tobacco at a pH of 5 and oven volatiles of about 45%; Sample 3: A tobacco adjusted to a pH of 7 with a buffering agent A and oven volatiles of about 45%; Sample 4: A tobacco adjusted to a pH of 7 with a buffering agent B and oven volatiles of about 45%; Sample 5: A tobacco adjusted to a pH of 7 with a buffering agent C and oven volatiles of about 45%; Sample 6: A tobacco adjusted to a pH with a buffering agent D and oven volatiles of about 45%; Sample 7: A tobacco adjusted to a pH of 8 with the buffering agent A and oven volatiles of about 45%; Sample 8: A tobacco adjusted to a pH 8 with the buffering agent B and oven volatiles of about 45%; Sample 9: A tobacco adjusted to a pH 8 with the buffering agent C and oven volatiles of about 45%; and Sample 10: A tobacco adjusted to a pH of 8 with the buffering agent D and oven volatiles of about 45%.

Conditioned test samples were tested at the dosage levels of 0 kGy, 10 kGy, and 20 kGy.

The control samples, which included a sample of each conditioned tobacco, were not subjected to the E-Beam treatment.

The nitrite content of the control and test samples were quantitatively determined by ion chromatography (IC) using a Dionex ICS 3000 Ion Chromatograph (IC instrument) with a conductivity detector, a autosampler, pump, and an eluent generator. The samples were prepared for testing by being ground and being allowed to reach room temperature, if applicable. 2.0 grams of each tobacco sample was obtained using an analytical balance and placed in a tared 125 mL Erlenmeyer flask. 100.0 mL of MilliQ water (Type 1 water supplied by Millipore Corporation, Billerica, MA, USA) was added to the flask using a dispenser. The flask was covered with a lid or equivalent. The samples were shaken on a benchtop platform shaker or equivalent device at 225 rpm for at least 30 minutes. Approximately 1 mL of each sample was placed directly into 1.5 mL autosample vial using a 0.22 μm PVDF syringe filter, and loaded into the IC instrument. The results were reported in units of μg/g and on a dry weight basis.

Figure 11:
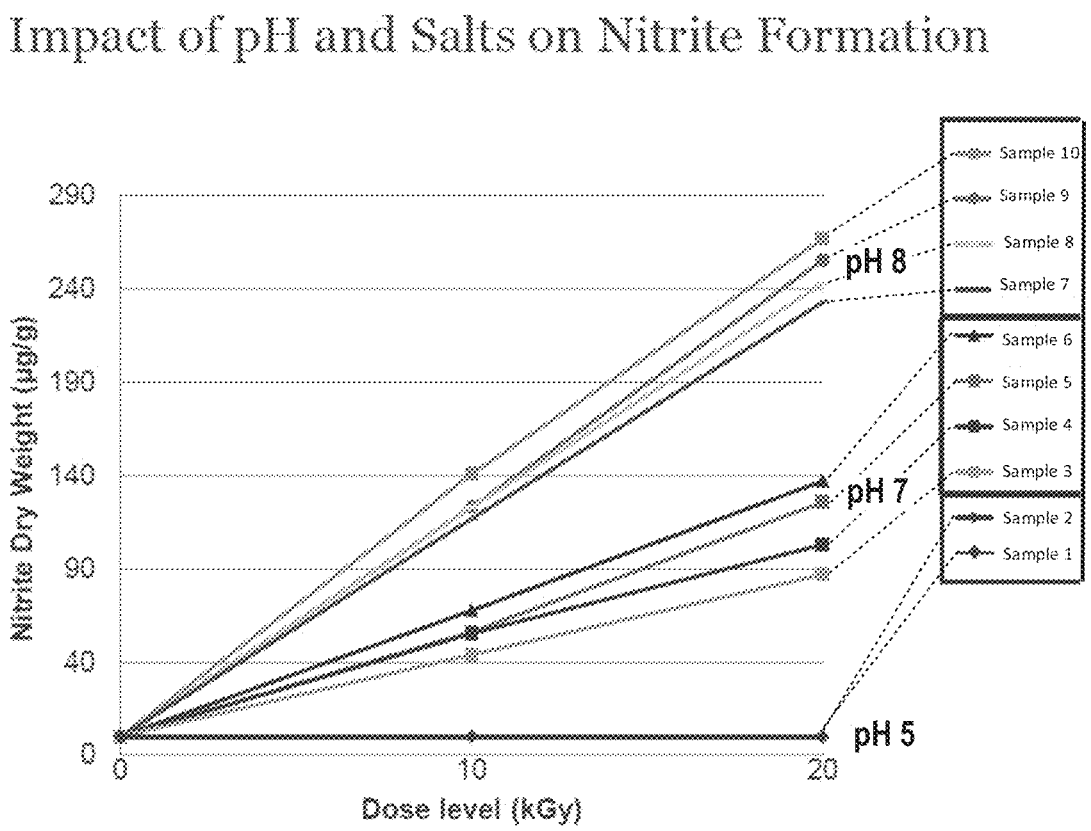
FIG. 11 is a graphical representation of fine-cut, unfermented tobacco tested with different E-Beam treatment dosages, and at different pH values according to at least one example embodiment.

As shown in FIG. 11, the pH of the tobacco correlated to the nitrite content detected in the tobacco. For example, the tobacco with a pH of 5, at any of the E-Beam dosage levels, did not have detectable amounts of nitrate. In contrast, the tobacco that had a pH of 7 or 8 at both the 10 and 20 kGy E-Beam treatment cycles showed detectable amounts of nitrites. The results show that tobaccos with a higher pH level (e.g., pH of 8) contained a higher amount of nitrite following the E-Beam treatment.

Furthermore, the experimental results showed that the E-Beam dosage level correlated to the amount of nitrite in the tobaccos having a higher pH value. For example, the tobacco with a pH of 7, when subjected to the dosage of 20 kGy, contained about 140 μg of nitrate per each gram of tobacco (dry weight), while the tobacco with a pH of 8, when subjected to the same dosage (20 kGy), contained about 260 μg of nitrate per each gram of tobacco (dry weight).

The results, as shown in FIG. 11, demonstrate that the pH value of the tobacco and the dosage level applied during E-Beam treatment are key parameters that correlate to the nitrite content detected in the tobacco.

Example 9

Exemplary fine-cut, dried, unfermented tobaccos having a pH of about 5.15 with different oven volatiles contents (i.e., amounts of moisture) were subjected to varying E-Beam treatment dosage levels, and tested for nitrite content.

Various test and control samples of the tobacco were conditioned in an oven to achieve a moisture oven volatile content of 5%, 15%, 25%, 35%, 45%, and 55% by weight before being subjected to the E-Beam treatment.

The conditioned test samples of each of the conditioned tobaccos were tested at the dosage levels of 0 kGy, 10 kGy, and 20 kGy.

The control samples of each of the conditioned tobaccos were not subjected to the E-Beam treatment.

The nitrite content of the control and test samples were quantitatively determined by the IC methodology described herein.

FIG. 11 provides a line graph showing the nitrite levels in the fine-cut, raw dried tobaccos with different oven volatiles contents (i.e., amounts of moisture) that were subjected to varying E-Beam treatment dosage levels. As shown, the oven volatile percentage of the tobacco correlated to the nitrite content in the tobacco. The results showed that an increased moisture level of the tobacco correlates to a lower amount or even no detectable amount of nitrite in the tobacco. For example, the tobaccos having the oven volatile content of about 25% or higher did not form detectable amounts of nitrite. FIG. 12 is a chart providing nitrite formation data for fine-cut, unfermented tobacco tested with different treatment dosages, and at different moisture content levels.

The experimental results showed that moisture level of the tobacco at a constant pH of about 3 to about 5 and the dosage level of the E-Beam treatment are critical parameters that correlate to the nitrite levels detected in the tobacco. The data showed that increasing the moisture level of the tobacco while decreasing the dosage level during the E-Beam treatment correlated to low or no detectable amounts of nitrite in the tobacco. In particular, tobacco having the oven volatile content of 5% by weight, when subjected to the E-Beam treatment dosage of 10 kGy, contained about 36.90 μg of nitrite per each gram of tobacco. In contrast, tobacco having the oven volatile content of 10% by weight, when subjected to the same E-Beam treatment dosage (10 kGy), had no detectable amounts of nitrite.

Example 10

Figure 13:
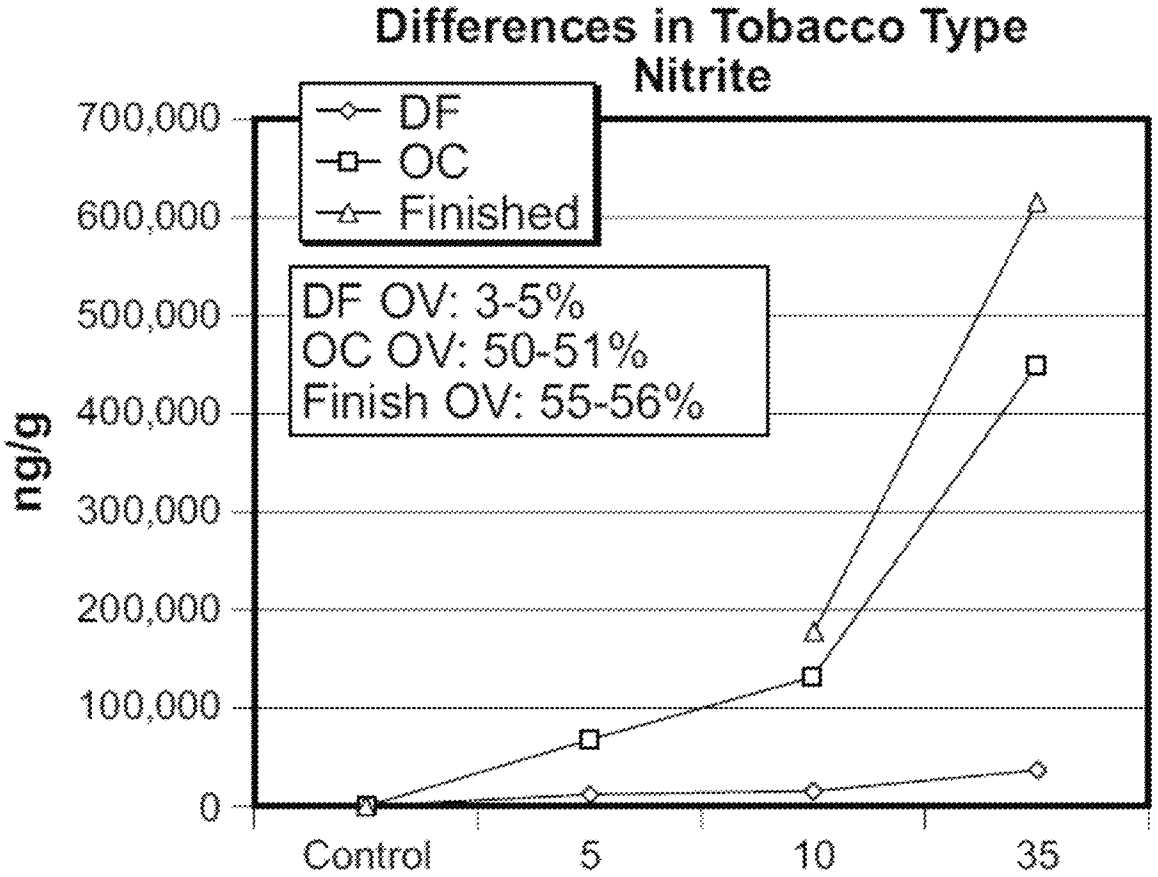
FIG. 13 is a graphical representation of nitrite levels (in units of μg of nitrite per gram of tobacco) in different exemplary forms of tobacco, including: 1) a dried unfermented tobacco, 2) a fermented tobacco, and 3) a finished tobacco product.

Different exemplary forms of tobacco, including 1) a dried, unfermented tobacco, 2) a fermented tobacco having a pH of about 7.2 to about 7.4, and 3) a finished tobacco product having a pH of about 7.6, were tested for nitrite content (in units of μg of nitrite per gram of tobacco). FIG. 13 provides the nitrite levels of the different forms of the tobacco.

Example 11

Various exemplary samples (Samples A, B, and C) of a fine-cut, dried raw (unfermented) tobacco having a pH of about 5.15 conditioned with different oven volatiles contents (including oven volatiles percentages of 5, 15, 25, 35, 45, and 55% by weight) were subjected to different E-Beam treatment dosage levels (including 0, 10 and 20 kGy). The samples were subsequently tested for nitrite content. FIG. 14 provides the nitrite levels of the various exemplary samples.

Example 12

Exemplary tobaccos, including a long-cut, unfermented tobacco and an undried, unfermented tobacco, were subjected to varying E-Beam treatment dosage levels (0, 10, 15, and 20 kGy) and tested for nitrite content. FIG. 15 shows the nitrite levels in the exemplary tobaccos having a pH of about 5.38.

Example 13

Figure 16:
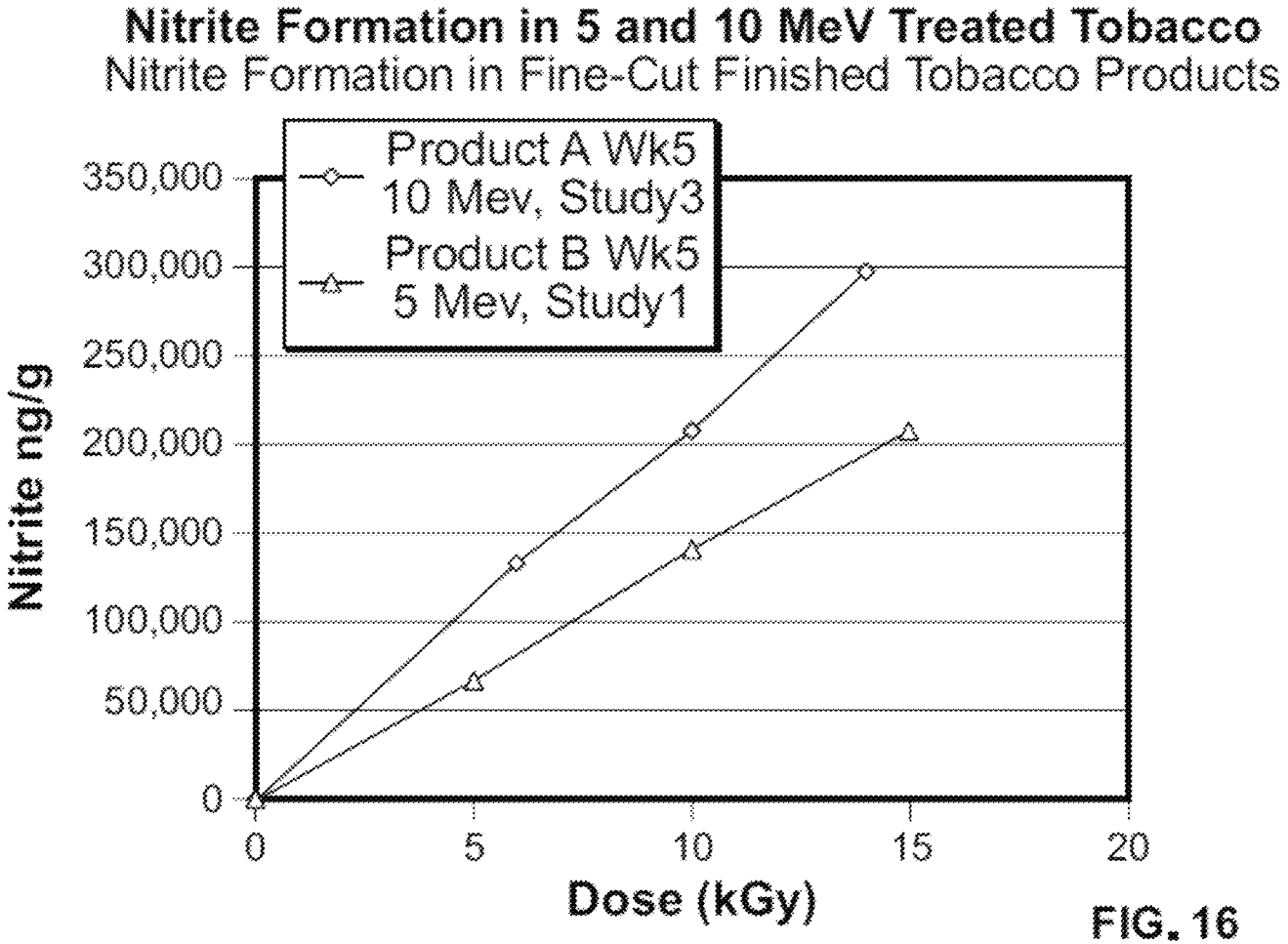
FIG. 16 is a graphical representation of nitrite levels in exemplary fine-cut, dried, unfermented tobacco subjected to varying E-Beam treatment dosage levels and E-Beam voltage amounts according to at least one example embodiment.

Exemplary fine-cut finished tobacco products (Product A and Product B) having a pH of about 7.6 and oven volatiles of about 57% subjected to varying E-Beam treatment dosage levels (0 kGy, 5 kGy, 10 kGy, 15 kGy, and 20 kGy) and E-Beam voltage amounts (5 MeV and 10 MeV) were tested for nitrite content. FIG. 16 shows the nitrite levels in these exemplary fine-cut finished tobacco products.

All publications, applications, references, and patents referred to in this application are herein incorporated by reference in their entirety. Other embodiments are within the claims.

We claim:

1. A method for producing a smokeless tobacco product comprising:

treating tobacco, the treating including, pre-conditioning the tobacco, pasteurizing the tobacco, curing the tobacco, fermenting the tobacco, or combinations thereof, and conditioning the tobacco, the conditioning including adjusting a pH and a moisture oven volatile content of the tobacco;

forming a product containing the tobacco, the forming being performed after the treating the tobacco and the conditioning the tobacco; and sterilizing the product, the sterilizing including applying an electron beam (E-Beam) to the tobacco, wherein the conditioning is performed during or prior to the sterilizing such that the sterilizing does not increase a nitrite level in the tobacco by greater than 300 micrograms of nitrite per gram of dry tobacco.

2. The method of claim 1, wherein the conditioning the tobacco is performed prior to the treating the tobacco.

3. The method of claim 1, wherein the conditioning the tobacco and the treating the tobacco are performed concurrently.

4. The method of claim 1, wherein the conditioning the tobacco is performed after the treating the tobacco and prior to the sterilizing the tobacco.

5. The method of claim 1, wherein the sterilizing the product is performed at an E-Beam treatment dosage ranging from about 0 kGy to about 20 kGy.

6. The method of claim 5, wherein the E-Beam treatment dosage ranges from about 10 kGy to about 20 kGy.

7. The method of claim 1, wherein the sterilizing the product is performed at an E-Beam treatment dosage of greater than or equal to about 10 kGy.

8. The method of claim 7, wherein the E-Beam treatment dosage is greater than or equal to about 15 kGy.

9. The method of claim 8, wherein the E-Beam treatment dosage is greater than or equal to about 20 kGy.

10. The method of claim 1, wherein the moisture oven volatile content of the tobacco is greater than about 5 percent by weight; and the sterilizing is performed at an E-Beam treatment dosage of greater than about 20 kGy.

11. The method of claim 1, wherein the moisture oven volatile content of the tobacco is greater than about 15 percent by weight; and the sterilizing is performed at an E-Beam treatment dosage of greater than about 10 kGy.

12. The method of claim 1, wherein the sterilizing the tobacco prevents microbial growth in the product for a duration of greater than or equal to about 10 weeks.

13. A method for producing a smokeless tobacco product comprising:

stabilizing tobacco, the stabilizing including, conditioning the tobacco, the conditioning including adjusting a pH and a moisture oven volatile content of the tobacco, and sterilizing tobacco, the sterilizing including applying an electron beam (E-Beam) to the; and forming a smokeless tobacco product containing the stabilized tobacco, wherein the conditioning is performed during or prior to the sterilizing tobacco such that the stabilizing does not increase a nitrite level in the tobacco by greater than 300 micrograms of nitrite per gram of dry tobacco.

14. A smokeless tobacco product comprising:

stabilized, fermented tobacco produced by a method comprising:

conditioning tobacco, the conditioning including adjusting a pH and a moisture oven volatile content of the tobacco;

stabilizing tobacco, the stabilizing including applying an electron beam (E-Beam) to the tobacco;

treating the tobacco, the treating including, pre-conditioning the tobacco, pasteurizing the tobacco, curing the tobacco, fermenting the tobacco, or combinations thereof; and adding the stabilized, fermented tobacco in a tobacco container, wherein the conditioning is performed during or prior to the stabilizing such that the stabilizing does not increase a nitrite level in the tobacco by greater than 300 micrograms of nitrite per gram of dry tobacco.

15. The method of claim 1, wherein the conditioning includes adjusting the pH of the tobacco to less than or equal to 5.

16. The method of claim 1, wherein the conditioning includes adding a pH buffering agent to the tobacco.

17. The method of claim 16, wherein the conditioning includes adding an alkalizing agent to the tobacco.

18. The method of claim 16, wherein the conditioning includes adding an acidifying agent to the tobacco.

19. The method of claim 1, wherein the forming includes forming a chewable oral product, a dissolvable oral product, a tobacco gum, chewing tobacco, dry snuff, or moist snuff.

20. The method of claim 1, wherein the conditioning includes reducing an oven volatile content of the tobacco.

* * * * *